US012059028B2

(12) United States Patent
Schennum et al.

(10) Patent No.: US 12,059,028 B2
(45) **Date of Patent: *Aug. 13, 2024**

(54) CONTAINER

(71) Applicant: Nicoventures Trading Limited, London (GB)

(72) Inventors: Steve Schennum, Oakbrook Terrace, IL (US); Tom McKeon, Oakbrook Terrace, IL (US); Jeremy Abel, Oakbrook Terrace, IL (US)

(73) Assignee: NICOVENTURES TRADING LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/564,476

(22) Filed: Sep. 9, 2019

(65) Prior Publication Data

US 2020/0000144 A1 Jan. 2, 2020

Related U.S. Application Data

(62) Division of application No. 14/895,599, filed as application No. PCT/GB2014/051633 on May 29, 2014, now Pat. No. 10,426,193.

(Continued)

(30) Foreign Application Priority Data

Mar. 31, 2014 (GB) ..... 1405720

(51) Int. Cl.
*A24F 15/00* (2020.01)
*A24F 15/12* (2006.01)

(Continued)

(52) U.S. Cl.
CPC ..... *A24F 15/12* (2013.01); *A24F 15/20* (2013.01); *A24F 40/95* (2020.01); *B65D 43/16* (2013.01);

(Continued)

(58) Field of Classification Search
CPC ..... A24F 47/002; A24F 15/00; A24F 15/12; A24F 47/008; B65D 85/20; B65D 85/10; B65D 81/24; B65D 43/16; B65D 43/26

(Continued)

(56) References Cited

U.S. PATENT DOCUMENTS 228,598 A 6/1880 Buckley
353,327 A 11/1886 Randolph (Continued)

FOREIGN PATENT DOCUMENTS

AT 507 187 3/2010
AT 508244 A4 12/2010

(Continued)

OTHER PUBLICATIONS

Application and File History for U.S. Appl. No. 14/888,517, filed Nov. 2, 2015, inventor Reevell.

(Continued)

*Primary Examiner* — Steven A. Reynolds
(74) *Attorney, Agent, or Firm* — Husch Blackwell LLP

(57) ABSTRACT

Embodiments relate to a container for an elongate electronic nicotine delivery system or other flavored vapor delivery system. The container has a rigid elongate body which defines a chamber including an end and an insert received in the end having first and ancillary openings that lead into the chamber. The insert includes a dividing wall to separate the first and ancillary openings in the insert so that an elongate electronic nicotine delivery system inserted into the chamber through the first opening protrudes therefrom and is supported in an upright position within the chamber by the insert. A lid is pivotally attached to the body so that it covers the first and ancillary openings in the insert in a closed position.

19 Claims, 11 Drawing Sheets

Related U.S. Application Data

(60) Provisional application No. 61/830,915, filed on Jun. 4, 2013.

(51) Int. Cl.

| | |
|---|---|
| ***A24F 15/20*** | (2006.01) |
| ***A24F 40/95*** | (2020.01) |
| ***B65D 43/16*** | (2006.01) |
| ***B65D 51/24*** | (2006.01) |
| ***B65D 85/10*** | (2006.01) |
| ***B65D 85/20*** | (2006.01) |

(52) U.S. Cl.
CPC ..... *B65D 51/24* (2013.01); *B65D 85/10* (2013.01); *B65D 85/20* (2013.01)

(58) Field of Classification Search
USPC ..... 206/242, 268
See application file for complete search history.

(56) References Cited

U.S. PATENT DOCUMENTS 576,653 A 2/1897 Bowlby
595,070 A 12/1897 Oldenbusch
744,074 A 11/1903 Hiering
799,844 A 9/1905 Fuller
885,374 A 4/1908 Pohlig
1,163,183 A 12/1915 Stoll
1,174,406 A 3/1916 Gillan
D53,386 S 5/1919 Thomas
1,436,157 A 11/1922 Fazio
1,512,098 A 10/1924 Hough
1,807,936 A 6/1931 Saunders
1,815,069 A 7/1931 Petro
1,923,560 A 8/1933 Whittaker
1,934,629 A 11/1933 Reilly
1,937,120 A 11/1933 Lagerholm
1,937,987 A 12/1933 Sexton
2,057,353 A 10/1936 Whittemore
2,262,318 A 11/1941 Fox
2,411,946 A 12/1946 Vogel
2,467,923 A 4/1949 Allen
2,483,304 A 9/1949 Vogel
2,513,672 A 7/1950 Vincent
2,522,952 A 9/1950 Krohn
2,544,501 A 3/1951 Johnson
2,658,368 A 11/1953 Siegal
2,782,910 A 2/1957 Krohn
2,809,634 A 10/1957 Hirotada et al.
3,023,922 A * 3/1962 Arrington ..... B65D 81/3876 220/23.91
3,111,396 A 11/1963 Ball
3,165,225 A 1/1965 Reitzel
3,402,724 A 9/1968 Blount et al.
3,431,393 A 3/1969 Katsuda et al.
3,433,632 A 3/1969 Elbert et al.
3,521,643 A 7/1970 Toth et al.
3,604,428 A 9/1971 Moukaddem
3,722,742 A 3/1973 Wertz
3,743,136 A 7/1973 Chambers
3,804,100 A 4/1974 Fariello
3,861,523 A 1/1975 Fountain et al.
3,861,565 A * 1/1975 Rickmeier, Jr. ..... A47G 19/12 222/131
3,863,803 A 2/1975 Valcic
3,964,902 A 6/1976 Fletcher et al.
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,190,412 A 2/1980 Tokai
4,193,513 A 3/1980 Bull, Jr.
4,214,658 A 7/1980 Crow
4,411,088 A * 10/1983 Wilson ..... F41C 9/085 42/90
4,503,851 A 3/1985 Braunroth
D279,508 S 7/1985 Bauer et al.
4,588,976 A 5/1986 Jaselli
4,676,237 A 6/1987 Wood et al.
4,733,794 A 3/1988 Kent
4,735,217 A 4/1988 Gerth et al.
4,753,383 A 6/1988 Focke et al.
4,793,478 A 12/1988 Tudor
4,805,790 A * 2/1989 Leonetti ..... B65D 47/0814 215/235
4,830,028 A 5/1989 Lawson et al.
4,848,374 A 7/1989 Chard et al.
4,885,129 A 12/1989 Leonard et al.
4,917,301 A 4/1990 Munteanu
4,922,901 A 5/1990 Brooks et al.
4,923,059 A 5/1990 Evers et al.
4,947,874 A 8/1990 Brooks et al.
4,947,875 A 8/1990 Brooks et al.
4,961,438 A 10/1990 Korte
4,978,814 A 12/1990 Honour
5,027,837 A 7/1991 Clearman et al.
5,044,550 A 9/1991 Lamm
5,046,514 A 9/1991 Bolt
5,054,662 A * 10/1991 Santagiuliana ..... B67D 3/047 222/534
5,060,671 A 10/1991 Counts et al.
D322,687 S 12/1991 Tschudin
5,095,647 A 3/1992 Zobele et al.
5,095,921 A 3/1992 Losee et al.
5,099,861 A 3/1992 Clearman et al.
5,121,881 A 6/1992 Lembeck
5,167,242 A 12/1992 Turner et al.
5,179,966 A 1/1993 Losee et al.
5,247,947 A 9/1993 Clearman et al.
D346,878 S 5/1994 Gee et al.
5,322,075 A 6/1994 Deevi et al.
5,353,956 A * 10/1994 Wilson ..... A45D 40/02 206/800
5,388,574 A 2/1995 Ingebrethsen
5,390,864 A 2/1995 Alexander
5,448,317 A 9/1995 Huang
5,479,948 A 1/1996 Counts
5,497,792 A 3/1996 Prasad et al.
5,501,236 A 3/1996 Hill et al.
5,505,214 A 4/1996 Collins et al.
5,540,241 A 7/1996 Kim
5,553,791 A 9/1996 Alexander
5,636,787 A 6/1997 Gowhari
5,649,554 A 7/1997 Sprinkel et al.
5,666,977 A 9/1997 Higgins et al.
5,692,291 A 12/1997 Deevi et al.
D392,069 S 3/1998 Rowland
5,743,251 A 4/1998 Howell
D404,201 S 1/1999 Wennerstrom
5,865,185 A 2/1999 Collins et al.
5,896,984 A 4/1999 Focke
5,938,017 A * 8/1999 Wik ..... A24F 15/20 131/270
D414,892 S 10/1999 Chen
5,967,312 A 10/1999 Jacobs
5,996,783 A 12/1999 Herchelroth
6,029,866 A * 2/2000 Wood ..... B29C 45/1676 222/536
6,065,592 A 5/2000 Wik
6,070,591 A * 6/2000 Bryer ..... A24F 13/18 131/233
6,095,505 A 8/2000 Miller
D432,263 S 10/2000 Issa
D434,217 S 11/2000 Packard et al.
D434,979 S 12/2000 Liu
6,155,268 A 12/2000 Takeuchi
D436,725 S 1/2001 Rogers
D438,003 S 2/2001 Minagawa et al.
D441,133 S 4/2001 Emery
6,275,650 B1 8/2001 Lambert
D449,521 S 10/2001 Pinkus et al.
6,321,757 B1 11/2001 McCutcheon

(56) References Cited

U.S. PATENT DOCUMENTS 6,394,323 B2 * 5/2002 McClean ..... B65D 47/2006 220/837
6,446,793 B1 9/2002 Layshock
D466,012 S 11/2002 Baker
D470,765 S 2/2003 Baker
D471,804 S 3/2003 Staples
D472,012 S 3/2003 South
6,527,166 B1 3/2003 Focke et al.
6,530,495 B1 3/2003 Joseph
6,561,391 B1 5/2003 Baker
6,652,804 B1 11/2003 Neumann et al.
6,681,998 B2 1/2004 Sharpe et al.
6,701,921 B2 3/2004 Spinklel, Jr. et al.
6,715,605 B1 4/2004 Manservigi et al.
6,726,006 B1 * 4/2004 Funderburk ..... B65B 19/20 206/256
6,736,143 B2 5/2004 Rennecamp
D493,617 S 8/2004 Armato
6,790,496 B1 9/2004 Levander et al.
D509,732 S 9/2005 Staples
7,100,618 B2 9/2006 Dominguez
7,112,712 B1 9/2006 Ancell
7,235,940 B2 2/2007 Cea
D545,186 S 6/2007 Liebe et al.
D549,573 S 8/2007 Liebe et al.
7,263,282 B2 8/2007 Meyer
D550,455 S 9/2007 Barnhart
7,325,940 B2 * 2/2008 Cea ..... A45C 11/16 206/566
D566,329 S 4/2008 Bagaric et al.
D566,890 S 4/2008 Bagaric et al.
7,389,878 B1 * 6/2008 Torrico ..... H05K 5/0278 361/730
D573,889 S 7/2008 Short et al.
7,400,940 B2 7/2008 McRae et al.
D575,451 S 8/2008 Jones et al.
7,455,176 B2 11/2008 Focke et al.
7,540,286 B2 6/2009 Cross et al.
7,565,969 B2 7/2009 He
D606,854 S 12/2009 Greenhalgh
D610,983 S 3/2010 Wai et al.
D611,806 S 3/2010 Bried
D613,903 S 4/2010 Wu
D613,904 S 4/2010 Wu
D616,753 S 6/2010 Beam et al.
7,767,698 B2 8/2010 Warchol et al.
7,832,410 B2 11/2010 Hon
D628,469 S 12/2010 Taylor et al.
D631,838 S 2/2011 Cheng
D636,257 S 4/2011 Bougoulas et al.
7,992,554 B2 8/2011 Radomski
D649,658 S 11/2011 Belfrance et al.
D650,738 S 12/2011 Leung
8,113,343 B2 2/2012 Akerlind
D656,094 S 3/2012 Wu
8,156,944 B2 4/2012 Han
D661,016 S 5/2012 Borges et al.
D671,677 S 11/2012 Wu
D671,678 S 11/2012 Wu
8,307,834 B1 11/2012 Palmerino, Sr. et al.
D672,642 S 12/2012 Supranowicz
D674,539 S 1/2013 Wu
8,365,742 B2 2/2013 Hon
8,375,957 B2 2/2013 Hon
8,393,331 B2 3/2013 Hon
8,430,106 B2 4/2013 Potter et al.
8,448,783 B2 5/2013 Vecchi
D683,898 S * 6/2013 Liu ..... D27/189
8,490,628 B2 7/2013 Hon
8,511,318 B2 8/2013 Hon
D693,055 S 10/2013 Manca et al.
8,602,210 B2 12/2013 Milner
D700,397 S 2/2014 Manca et al.
8,689,805 B2 4/2014 Hon
8,752,545 B2 6/2014 Buchberger
8,794,245 B1 8/2014 Scatterday
8,833,364 B2 9/2014 Buchberger
D715,760 S 10/2014 Kim et al.
D716,267 S 10/2014 Kim et al.
8,910,783 B2 * 12/2014 Liu ..... A24F 15/12 206/266
D720,884 S * 1/2015 Liu ..... D27/189
8,948,578 B2 2/2015 Buchberger
D723,734 S * 3/2015 Liu ..... D27/189
D723,736 S * 3/2015 Liu ..... D27/189
D723,737 S * 3/2015 Liu ..... D27/189
D723,738 S * 3/2015 Liu ..... D27/189
D736,460 S 8/2015 McKeon et al.
D737,507 S 8/2015 Liu
D738,716 S 9/2015 Nettenstrom
D755,044 S 5/2016 Nettenstrom
9,623,205 B2 4/2017 Buchberger
10,426,193 B2 * 10/2019 Schennum ..... B65D 43/16
2001/0042546 A1 11/2001 Umeda et al.
2002/0016370 A1 2/2002 Shytle et al.
2002/0079309 A1 6/2002 Cox et al.
2003/0005620 A1 1/2003 Anath et al.
2003/0049025 A1 3/2003 Neumann et al.
2003/0106552 A1 6/2003 Sprinkel, Jr. et al.
2003/0200964 A1 10/2003 Blakley et al.
2004/0031485 A1 2/2004 Rustad et al.
2004/0056651 A1 3/2004 Marietta
2004/0129793 A1 7/2004 Nguyen et al.
2005/0087460 A1 4/2005 Bruhn et al.
2005/0204799 A1 9/2005 Koch
2005/0211243 A1 9/2005 Esser
2005/0224375 A1 10/2005 Focke et al.
2005/0268911 A1 12/2005 Cross et al.
2006/0078477 A1 4/2006 Althouse
2007/0014549 A1 1/2007 Demarest et al.
2007/0062548 A1 3/2007 Horstmann
2007/0102013 A1 5/2007 Adams et al.
2007/0107879 A1 5/2007 Radomski et al.
2007/0115653 A1 5/2007 Cea et al.
2007/0155255 A1 7/2007 Galauner et al.
2007/0193895 A1 8/2007 Weiss et al.
2007/0267032 A1 11/2007 Shan
2008/0017204 A1 1/2008 Braunshteyn et al.
2008/0083627 A1 * 4/2008 Hamm ..... A45C 11/04 206/6
2008/0092912 A1 4/2008 Robinson et al.
2008/0216828 A1 9/2008 Wensley
2008/0223382 A1 9/2008 Zeanah
2009/0095311 A1 4/2009 Han
2009/0188490 A1 7/2009 Han
2009/0223841 A1 * 9/2009 Mack, Jr. ..... A24F 15/14 206/242
2009/0266837 A1 10/2009 Gelardi et al.
2009/0272379 A1 11/2009 Thorens et al.
2009/0288966 A1 11/2009 Minarelli et al.
2009/0293892 A1 12/2009 Williams
2010/0059070 A1 3/2010 Potter et al.
2010/0065653 A1 3/2010 Wingo et al.
2010/0083959 A1 4/2010 Siller
2010/0108059 A1 5/2010 Axelson et al.
2010/0236546 A1 9/2010 Yamada et al.
2010/0313901 A1 12/2010 Fernando et al.
2011/0011396 A1 1/2011 Fang
2011/0036363 A1 2/2011 Urtsev et al.
2011/0126848 A1 6/2011 Zuber et al.
2011/0180433 A1 7/2011 Rennecamp
2011/0218502 A1 * 9/2011 Iio ..... H02J 7/0042 604/264
2011/0226236 A1 9/2011 Buchberger
2011/0290267 A1 12/2011 Yamada et al.
2011/0297166 A1 12/2011 Takeuchi et al.
2011/0303231 A1 12/2011 Li et al.
2012/0103842 A1 5/2012 Koester
2012/0145169 A1 6/2012 Wu
2012/0199146 A1 8/2012 Marangos
2012/0227752 A1 9/2012 Alelov
2012/0227753 A1 * 9/2012 Newton ..... A24F 47/008 131/347
2012/0260927 A1 10/2012 Liu

(56) References Cited

U.S. PATENT DOCUMENTS

| | | | | |
|---|---|---|---|---|
| 2012/0285476 | A1 | 11/2012 | Hon | |
| 2013/0074857 | A1 | 3/2013 | Buchberger | |
| 2013/0081623 | A1 | 4/2013 | Buchberger | |
| 2013/0098786 | A1 | 4/2013 | Collins | |
| 2013/0192615 | A1 | 8/2013 | Tucker et al. | |
| 2013/0192621 | A1 | 8/2013 | Li et al. | |
| 2013/0192623 | A1 | 8/2013 | Tucker | |
| 2013/0213419 | A1 | 8/2013 | Tucker et al. | |
| 2013/0284192 | A1 | 10/2013 | Peleg et al. | |
| 2013/0333700 | A1 | 12/2013 | Buchberger | |
| 2013/0340779 | A1 | 12/2013 | Liu | |
| 2013/0341218 | A1 | 12/2013 | Liu | |
| 2013/0342157 | A1 | 12/2013 | Liu | |
| 2014/0000638 | A1 | 1/2014 | Sebastian et al. | |
| 2014/0007892 | A1 | 1/2014 | Liu | |
| 2014/0020697 | A1 | 1/2014 | Liu | |
| 2014/0048086 | A1 | 2/2014 | Zhanghua | |
| 2014/0053858 | A1 | 2/2014 | Liu | |
| 2014/0060528 | A1 | 3/2014 | Liu et al. | |
| 2014/0060554 | A1 | 3/2014 | Collett et al. | |
| 2014/0060555 | A1 | 3/2014 | Chang et al. | |
| 2014/0196717 | A1 | 7/2014 | Liu | |
| 2014/0196731 | A1* | 7/2014 | Scatterday | A45C 13/007 131/329 |
| 2014/0202454 | A1 | 7/2014 | Buchberger | |
| 2014/0209105 | A1 | 7/2014 | Sears et al. | |
| 2014/0238396 | A1 | 8/2014 | Buchberger | |
| 2014/0238423 | A1 | 8/2014 | Tucker et al. | |
| 2014/0238424 | A1 | 8/2014 | Macko et al. | |
| 2014/0261490 | A1 | 9/2014 | Kane | |
| 2014/0261495 | A1 | 9/2014 | Novak, III et al. | |
| 2014/0270730 | A1 | 9/2014 | DePiano et al. | |
| 2014/0283825 | A1 | 9/2014 | Buchberger | |
| 2014/0286002 | A1 | 9/2014 | Liu | |
| 2014/0286630 | A1 | 9/2014 | Buchberger | |
| 2014/0299125 | A1 | 10/2014 | Buchberger | |
| 2014/0299492 | A1* | 10/2014 | Liu | A24F 15/12 206/264 |
| 2014/0338680 | A1 | 11/2014 | Abramov et al. | |
| 2015/0114411 | A1 | 4/2015 | Buchberger | |
| 2015/0208728 | A1 | 7/2015 | Lord | |
| 2016/0073693 | A1 | 3/2016 | Reevell | |
| 2016/0101909 | A1 | 4/2016 | Schennum et al. | |
| 2016/0106154 | A1 | 4/2016 | Lord | |
| 2016/0106155 | A1 | 4/2016 | Reevell | |
| 2016/0120218 | A1 | 5/2016 | Schennum et al. | |
| 2017/0042245 | A1 | 2/2017 | Buchberger et al. | |
| 2017/0188629 | A1 | 7/2017 | Dickens et al. | |
| 2017/0197043 | A1 | 7/2017 | Buchberger | |
| 2017/0197044 | A1 | 7/2017 | Buchberger | |
| 2017/0197046 | A1 | 7/2017 | Buchberger | |

FOREIGN PATENT DOCUMENTS

| | | | |
|---|---|---|---|
| AT | 510 405 | | 4/2012 |
| AU | 6393173 | A | 6/1975 |
| BR | 6402132 | | 7/1986 |
| CA | 2309376 | A1 | 11/2000 |
| CH | 698603 | B1 | 9/2009 |
| CL | 199400288 | | 8/1995 |
| CN | 2092880 | U | 1/1992 |
| CN | 2220168 | Y | 2/1996 |
| CN | 1312730 | | 12/2001 |
| CN | 1329567 | | 1/2002 |
| CN | 2485265 | | 4/2002 |
| CN | 2558618 | Y | 7/2003 |
| CN | 2595187 | Y | 12/2003 |
| CN | 2660914 | | 12/2004 |
| CN | 2719043 | Y | 8/2005 |
| CN | 1703279 | A | 11/2005 |
| CN | 2904674 | | 5/2007 |
| CN | 101115901 | | 1/2008 |
| CN | 201023852 | | 2/2008 |
| CN | 201238609 | Y | 5/2009 |
| CN | 201240612 | Y | 5/2009 |
| CN | 201370099 | Y | 12/2009 |
| CN | 201375023 | Y | 1/2010 |
| CN | 201430913 | Y | 3/2010 |
| CN | 201592850 | | 9/2010 |
| CN | 101878958 | A | 11/2010 |
| CN | 201657770 | U | 12/2010 |
| CN | 101939229 | A | 1/2011 |
| CN | 102014677 | A | 4/2011 |
| CN | 201830900 | U | 5/2011 |
| CN | 201860753 | U | 6/2011 |
| CN | 102264420 | A | 11/2011 |
| CN | 202122096 | | 1/2012 |
| CN | 202172846 | U | 3/2012 |
| CN | 102655773 | | 9/2012 |
| CN | 202722498 | | 2/2013 |
| CN | 202750708 | U | 2/2013 |
| CN | 106102863 | | 11/2016 |
| DE | 594585 | | 3/1934 |
| DE | 1950439 | A1 | 4/1971 |
| DE | 2940797 | | 4/1981 |
| DE | 3148335 | A1 | 7/1983 |
| DE | 3218760 | A1 | 12/1983 |
| DE | 3936687 | A1 | 5/1990 |
| DE | 19630619 | A1 | 2/1998 |
| DE | 19654945 | A1 | 3/1998 |
| DE | 10330681 | | 6/2004 |
| DE | 202006013439 | U1 | 10/2006 |
| DE | 202013100606 | | 2/2013 |
| EP | 0295122 | | 12/1988 |
| EP | 280262 | A2 | 8/1989 |
| EP | 0358114 | | 5/1990 |
| EP | 0488488 | A1 | 1/1991 |
| EP | 0444553 | A2 | 9/1991 |
| EP | 0845220 | A1 | 6/1998 |
| EP | 0893071 | A1 | 1/1999 |
| EP | 1166814 | A2 | 1/2002 |
| EP | 1166847 | | 1/2002 |
| EP | 1736065 | A1 | 12/2006 |
| EP | 1820748 | A1 | 8/2007 |
| EP | 1847671 | | 10/2007 |
| EP | 1950439 | | 7/2008 |
| EP | 2018886 | A1 | 1/2009 |
| EP | 2022349 | A1 | 2/2009 |
| EP | 2113178 | A1 | 11/2009 |
| EP | 2234891 | A2 | 10/2010 |
| EP | 2253233 | A1 | 11/2010 |
| EP | 2340729 | A1 | 7/2011 |
| EP | 2698070 | A1 | 2/2014 |
| EP | 2762019 | A1 | 8/2014 |
| EP | 2835062 | A1 | 2/2015 |
| FR | 472030 | | 11/1914 |
| FR | 960469 | A | 4/1950 |
| FR | 1292446 | | 5/1962 |
| GB | 190930472 | | 12/1909 |
| GB | 191100628 | | 11/1911 |
| GB | 25575 | A | 3/1912 |
| GB | 191311086 | A | 9/1913 |
| GB | 110216 | | 10/1917 |
| GB | 111454 | | 11/1917 |
| GB | 120016 | | 10/1918 |
| GB | 160493 | | 3/1921 |
| GB | 163124 | | 5/1921 |
| GB | 215992 | | 5/1924 |
| GB | 220229 | | 8/1924 |
| GB | 268967 | | 4/1927 |
| GB | 402064 | | 11/1933 |
| GB | 507955 | | 6/1939 |
| GB | 544329 | | 4/1942 |
| GB | 565574 | | 11/1944 |
| GB | 611596 | | 11/1948 |
| GB | 626888 | | 7/1949 |
| GB | 871869 | | 7/1961 |
| GB | 1313525 | A | 4/1973 |
| GB | 1046183 | | 7/1988 |
| GB | 2275464 | | 8/1994 |
| GB | 2068034 | | 11/1997 |
| GB | 2369108 | | 5/2002 |
| GB | 4000273 | | 12/2006 |

(56) References Cited

FOREIGN PATENT DOCUMENTS

| | | | |
|---|---|---|---|
| GB | 4006615 | | 10/2008 |
| HK | 1196511 | | 12/2014 |
| HK | 1193081 | A1 | 1/2016 |
| HK | 1226611 | | 10/2017 |
| JP | S5289386 | A | 7/1977 |
| JP | S5289386 | U | 7/1977 |
| JP | S57-052456 | A | 3/1982 |
| JP | 57S-140354 | U | 8/1982 |
| JP | S59-106340 | | 1/1986 |
| JP | 61-096765 | | 1/1988 |
| JP | S61-0967735 | | 1/1988 |
| JP | H02-124081 | A | 5/1990 |
| JP | H5-103836 | A | 9/1991 |
| JP | H05-309136 | A | 11/1993 |
| JP | H6-315366 | A | 11/1994 |
| JP | H8-511176 | A | 10/1995 |
| JP | H08299862 | A | 11/1996 |
| JP | 11-503912 | | 4/1999 |
| JP | H1189551 | | 4/1999 |
| JP | 3093201 | U | 4/2003 |
| JP | 2004332069 | A | 11/2004 |
| JP | 2005-013092 | | 1/2005 |
| JP | 2005-138773 | | 6/2005 |
| JP | 2005-537919 | | 12/2005 |
| JP | 2005-538159 | A | 12/2005 |
| JP | 2007-297124 | | 11/2007 |
| JP | 2009-526714 | | 7/2009 |
| JP | 2010521161 | A | 6/2010 |
| JP | 2011-087569 | | 5/2011 |
| JP | 2011-518567 | | 6/2011 |
| JP | 2012527222 | A | 11/2012 |
| JP | 2013524835 | A | 6/2013 |
| NL | 6617184 | | 6/1967 |
| RU | 2336001 | C2 | 10/2008 |
| RU | 2360583 | C1 | 7/2009 |
| RU | 89927 | U1 | 12/2009 |
| RU | 94815 | | 6/2010 |
| RU | 103281 | U1 | 4/2011 |
| RU | 115629 | U1 | 5/2012 |
| RU | 121706 | | 11/2012 |
| RU | 122000 | U1 | 11/2012 |
| RU | 124120 | U1 | 1/2013 |
| UA | 78167 | | 3/2013 |
| WO | WO 95/27412 | A1 | 10/1995 |
| WO | WO-9632854 | A2 | 10/1996 |
| WO | WO-0009188 | A1 | 2/2000 |
| WO | WO-0021598 | A1 | 4/2000 |
| WO | WO2002058747 | | 8/2002 |
| WO | WO2002060769 | | 8/2002 |
| WO | WO-03028409 | A1 | 4/2003 |
| WO | WO-03050405 | A1 | 6/2003 |
| WO | WO2003183283 | | 10/2003 |
| WO | WO 03/094640 | A1 | 11/2003 |
| WO | WO 2003101454 | | 12/2003 |
| WO | WO-2004022243 | A1 | 3/2004 |
| WO | WO2005106350 | | 11/2005 |
| WO | WO-2006082571 | A1 | 8/2006 |
| WO | WO-2007042941 | A2 | 4/2007 |
| WO | WO2007060395 | A1 | 5/2007 |
| WO | WO-2007131449 | A1 | 11/2007 |
| WO | WO2008006048 | | 1/2008 |
| WO | WO2008104870 | | 9/2008 |
| WO | WO-2009015410 | A1 | 2/2009 |
| WO | WO2009019217 | A1 | 2/2009 |
| WO | WO-2009092419 | A2 | 7/2009 |
| WO | WO2009/092419 | | 9/2009 |
| WO | WO 2009/132793 | | 11/2009 |
| WO | WO-2010045670 | A1 | 4/2010 |
| WO | WO-2010045671 | A1 | 4/2010 |
| WO | WO 2011/109849 | | 9/2011 |
| WO | WO2011137453 | A2 | 11/2011 |
| WO | WO2012025496 | | 3/2012 |
| WO | WO 2012/065310 | A1 | 5/2012 |
| WO | WO2012065754 | | 5/2012 |
| WO | WO2012114082 | | 8/2012 |
| WO | WO2013034453 | | 3/2013 |
| WO | WO2013034460 | | 3/2013 |
| WO | WO2013045942 | | 4/2013 |
| WO | WO-2013057185 | A1 | 4/2013 |
| WO | WO2013098395 | | 7/2013 |
| WO | WO2013116558 | | 8/2013 |
| WO | WO2013142671 | | 9/2013 |
| WO | WO2013189050 | | 12/2013 |
| WO | WO2013189052 | | 12/2013 |
| WO | WO2014005275 | | 1/2014 |
| WO | WO2014015463 | | 1/2014 |
| WO | WO-2014130695 | A1 | 8/2014 |
| WO | WO2014140320 | | 9/2014 |
| WO | WO2014150131 | | 9/2014 |
| WO | WO2013082173 | | 10/2014 |

OTHER PUBLICATIONS

Application and File History for U.S. Appl. No. 14/895,446, filed Dec. 2, 2015, inventor Schennum et al.

Application and File History for U.S. Design U.S. Appl. No. 29/475,565, filed Dec. 4, 2013, inventors McKeon et al.

International Search Report and Written Opinion for International Application No. PCT/GB2014/051332 mailed Jul. 21, 2014.

International Search Report and Written Opinion for International Application No. PCT/GB2014/051688 mailed Aug. 26, 2014.

Office Action dated Sep. 3, 2014, for Russian Application No. 2013504605. English Translation Provided.

International Preliminary Report on Patentability and Written Opinion dated Nov. 12, 2015 for International Application No. PCT/GB2014/4839051332.

Application and File History for Design U.S. Appl. No. 29/503,949, filed Sep. 3, 2014, inventors Schennum et al.

Application and File History for U.S. Appl. No. 29/503,949, filed Sep. 30, 2014, Inventor Schennum.

Chinese Notification of First Office Action for Chinese Application No. 201480031926.5 dated Apr. 21, 2017.

Chinese Office Action for Chinese Application No. 201480024988.3 dated Dec. 30, 2016.

Chinese Office Action for Chinese Application No. 201480031296.1 dated Mar. 27, 2017.

Chinese Office Action for Chinese Application No. 201480024988.3 dated Sep. 11, 2017.

Decision to Grant in Russian Application No. 120267, dated Oct. 26, 2016, 7 pages, no English translation available.

Dunn et al., Heat Pipes, 4th Edition, 1994, ISBN 0080419038, 14 pgs.

European Search Report for European Application No. 16166656 dated Oct. 25, 2016.

Great Britain Examination Report, Application No. GB1405720.2, dated Jun. 27, 2017, 3 pages.

GB Intention to Grant, Application No. GB1405720.2, dated Sep. 26, 2017, 2 pages.

International Preliminary Report on Patentability dated Apr. 26, 2011, for International Application No. PCT/AT2009/000414, 7 pages.

IPRP dated Apr. 22, 2014 for International Patent Application No. PCT/EP2012/070647 filed Oct. 18, 2012.

IPRP, International Application No. PCT/GB2014/051334 mailed Nov. 12, 2015.

International Preliminary Report on Patentability for International Application No. PCT/GB2014/051688 dated Dec. 8, 2015.

IPRP for corresponding International Application No. PCT/GB2015/051213 mailed on Jul. 14, 2016; 21 pages.

International Search Report and Written Opinion for International Application No. PCT/GB2014/051333 mailed Jul. 17, 2014.

International Search Report of the International Searching Authority for International Application No. PCT/GB2014/051633 mailed Dec. 4, 2014.

International Search Report for International Application No. PCT/GB2014/051688 dated Aug. 26, 2014.

International Search Report for corresponding International Application No. PCT/GB2015/051213 mailed on Jul. 16, 2015; 5 pages.

(56) References Cited

OTHER PUBLICATIONS

Japanese Notice of Reasons for Refusal, dated Oct. 7, 2013 for Japanese Application No. 2011532464.
Japanese Notice of Reasons for Rejection mailed Sep. 8, 2015 for Japanese Application No. 2014179732.
Japanese Office Action for Application No. 2016-134648 dated May 23, 2017.
Korean Office Action, Korean Application No. 10-2015-7034538, dated May 12, 2017, 10 pages.
Notice of Opposition Letter from EPO. Opposition against EP 2358418 dated Mar. 1, 2017.
Notification of Transmittal of IPRP for International Application No. PCT/GB2014/051633 mailed Oct. 23, 2015.
Office Action dated Sep. 3, 2014, for Russian Application No. 2013504605.
Pulmonary Pharmacology: Delivery Devices and Medications, accessed at www.cdeu.org/cecourses/z98207/ch4.htm.
Rudolph, BAT Cigarettenfabriken GmbH, 1987, "The Influence of CO2 on the Sensory Charcteristics of the Favor-System," (Accessed at <http://legacy.library.ucsf.edu/tid/sld5f100>.
Russian Decision to Grant, Application No. 2015146845, dated Apr. 27, 2017, 8 pages.
Russian Office Action, Application No. 2015146847, dated Sep. 22, 2017, 11 pages.
Chinese First Office Action for Chinese Application No. 200980152395.4 date issued Dec. 3, 2012.
Chinese Second Office Action for Chinese Application No. 200980152395.4 date issued Aug. 20, 2013.
Translation of Search Report for JP2016517671 date of search Feb. 1, 2017.
Written Opinion, dated Jan. 26, 2010, for International Application No. PCT/AT2009/000414, 14 pages (with translation).
Written Opinion of the International Searching Authority for International Application No. PCT/GB2014/051633 mailed Dec. 4, 2014.
Written Opinion for International Application No. PCT/GB2014/051688 dated Aug. 26, 2014.
Written Opinion of the International Searching Authority for corresponding International Application No. PCT/GB2015/051213 mailed on Jul. 16, 2015; 9 pages.
Japanese Office Action, Application No. 2016-517671, dated Feb. 21, 2017, 3 pages.
Great Britain Office Action, Application No. GB1405720.2, dated Mar. 1, 2017, 4 pages.
Japanese Search Report, Application No. 2016-517671, dated Feb. 15, 2017, 13 pages.
Chinese Office Action, Application No. 201480031296.1, dated Nov. 29, 2017, 9 pages (17 pages with translation).
Chilean Office Action, Application No. 201503537, dated Mar. 21, 2018, 7 pages.
Application and File History for U.S. Appl. No. 13/125,343, filed Apr. 21, 2011, inventor Buchberger.
Application and File History for U.S. Appl. No. 14/235,210, filed Mar. 4, 2014, inventor Buchberger, 504 pages.
Application and File History for U.S. Appl. No. 14/296,803, filed Jun. 5, 2014, inventor Buchberger, 627 pages.
Application and File History for U.S. Appl. No. 14/353,256, filed Apr. 21, 2014, inventor Buchberger, 375 pages.
Application and File History for U.S. Appl. No. 14/594,065, filed Jan. 9, 2015, Inventor Buchberger, 302 pages.
Application and File History for U.S. Appl. No. 14/787,946, filed Oct. 29, 2015, inventor Lord, 228 pages.
Application and File History for U.S. Appl. No. 14/888,514, filed Nov. 2, 2015, inventor Reevell, 188 pages.
Application and File History for U.S. Appl. No. 14/895,599, filed Dec. 3, 2015, Inventors: Schennum et al., 8 pages.
Application and File History for U.S. Appl. No. 15/307,095, filed Oct. 27, 2016, inventor Buchberger, 288 pages.
Application and File History for U.S. Appl. No. 15/454,156, filed Mar. 9, 2017, inventor Buchberger, 61 pages.
Application and File History for U.S. Appl. No. 15/470,078, filed Mar. 27, 2017, inventor Buchberger, 392 pages.
Application and File History for U.S. Appl. No. 15/470,089, filed Mar. 27, 2017, inventor Buchberger, 558 pages.
Application and File History for U.S. Appl. No. 15/470,095, filed Mar. 27, 2017, inventor Buchberger, 351 pages.
Extended European Search Report for U.S. Appl. No. 15/178,588, mailed on Apr. 14, 2016, 2 pages.
Extended European Search Report for U.S. Appl. No. 16/166,656, mailed on Oct. 11, 2016, 9 pages.
First Office Action for Chinese Application No. 201480031926.5 dated Apr. 21, 2017, 12 pages.
International Search Report and Written Opinion of the International Searching Authority for Application No. PCT/GB2014/051633, mailed Dec. 4, 2014, 19 pages.
International Preliminary Report on Patentability for Application No. PCT/AT2012/000017, mailed on Aug. 13, 2013, 5 pages.
International Preliminary Report on Patentability for Application No. PCT/GB2014/051333, mailed on Aug. 5, 2015, 12 pages.
International Search Report and Written Opinion for Application No. PCT/AT2012/000017, mailed on Jul. 3, 2012, 6 pages.
International Search Report and Written Opinion for Application No. PCT/EP2012/003103, mailed on Nov. 26, 2012, 6 pages.
International Search Report and Written Opinion for Application No. PCT/EP2012/070647, mailed on Feb. 6, 2013, 9 pages.
International Search Report and Written Opinion for Application No. PCT/GB2014/051334, mailed on Jul. 21, 2014, 8 pages.
International Search Report for Application No. PCT/AT2009/000414, mailed on Jan. 26, 2010, 2 pages.
Kynol, "Standard Specifications of Kynol™ Activated Carbon Fiber Products," Sep. 19, 2013, 2 pages.
Notice of Reasons for Rejection mailed May 31, 2016 for Japanese Application No. 2015-137361, 6 pages.
Office Action for Chinese Application No. 201480031296.1, dated Mar. 27, 2017 16 pages.
Office Action mailed Jan. 18, 2017 for Chinese Application No. 201480024978.X, 8 pages.
Search Report mailed Apr. 24, 2017 for Russian Application No. 2015146843, 3 pages.
Written Opinion for Application No. PCT/AT2009/000414, mailed on Jan. 26, 2010, 14 pages.
Office Action and Search Report for Chinese Application No. 201911046490.8, mailed on Oct. 28, 2021, 17 pages.
Office Action For Chinese Application No. 201911046487.6, mailed on May 5, 2022, 16 pages.

* cited by examiner

CONTAINER

RELATED APPLICATION

This application is a division of application Ser. No. 14/895,599 filed Dec. 3, 2015, which is a National Phase entry of PCT Application No. PCT/GB2014/051633, filed May 29, 2014, which claims priority from U.S. Provisional Application No. 61/830,915, filed Jun. 4, 2013, and GB Patent Application No. 1405720.2, filed Mar. 31, 2014, each of which is hereby fully incorporated herein by reference.

TECHNICAL FIELD

Embodiments are related to containers for electronic nicotine delivery systems or other flavored vapor delivery systems, particularly but not exclusively to a container for an electronic cigarette.

BACKGROUND

Electronic nicotine delivery systems may be used in situations where traditional smoking is prohibited or inconvenient. Such devices may function by allowing a user to inhale a nicotine vapor from a liquid store by applying a suction force to a mouthpiece. Electronic nicotine delivery systems include electronic cigarettes.

SUMMARY

In accordance with embodiments, there is provided a container for an elongate electronic nicotine delivery system or other flavored vapor delivery system, the container comprising a rigid elongate body defining a chamber including an end and an insert received in said end having a first opening and an ancillary opening that each lead into the chamber, the insert including a dividing wall to separate the first and ancillary openings in the insert so that an elongate electronic nicotine delivery system inserted into the chamber through said first opening protrudes therefrom and is supported in an upright position within the chamber by said insert, a lid being pivotally attached to said body so that it covers said first and ancillary openings in the insert in a closed position.

The insert may be configured so that an elongate ancillary article inserted into the chamber through the ancillary opening protrudes therefrom and is supported in an upright position in the chamber by the insert. The ancillary article may, for example, comprise another electronic nicotine delivery system (or more generally another flavored vapor delivery system), a conventional cigarette, a set of instructions, an additional cartridge containing fluid (e.g. nicotine) for the electronic nicotine delivery system, or any other appropriate suitably shaped (elongate) object.

The insert may comprise a lip that protrudes in a direction away from the chamber and which cooperates with the lid when the lid is closed.

In accordance with embodiments, there is also provided a container for an electronic nicotine delivery system or other flavored vapor delivery system comprising a body defining a chamber having opposing side walls separated by end walls at a peripheral edge of each side wall, a lid to cover an open end of the chamber in a closed position, and a pin extending between the side walls that attaches the lid to the body for rotation about the longitudinal axis of the pin between open and closed positions, wherein the pin is also positioned so that it lies between the end walls.

The hinge may be configured so that the longitudinal axis of the pin extends substantially at right-angles to a direction in which an electronic nicotine delivery system is inserted into the chamber when the lid is in its open position.

The hinge may comprise a hinge member that extends from said lid into said chamber between opposing side walls of the body, said pin extending through said hinge member and side walls of the body.

The container may have an insert received in said open end of the container, the insert having a first opening and an ancillary opening that each lead into the chamber, the insert including a dividing wall to separate the first and ancillary openings in the insert so that an elongate electronic nicotine delivery system inserted into the chamber through said first opening protrudes therefrom and is supported in an upright position within the chamber by said insert.

The insert may include a lip that sits against an upper end of the side and end walls so that the lid contacts said lip in a closed position and covers said first and ancillary openings.

In one embodiment, the container further comprises a cam member which is biased into contact with the hinge member by a resilient member so that the lid is pivotable towards its open position against the biasing force of the resilient member.

The pin that extends through said hinge member and side walls of the body may also passes through the insert to retain said insert in the body.

In accordance with embodiments, there is also provided a container for an electronic nicotine delivery system or other flavored vapor delivery system comprising a body and a lid pivotally attached thereto, the lid and the body each having a pair of opposing side walls separated by opposing end walls to define a chamber to receive an electronic nicotine delivery system, wherein said opposing side walls of said body and said lid are arcuate in shape.

The opposing side walls may be longer than said opposing end walls, such that said container has a generally elongated arcuate shape.

The arcuate opposing side walls may have equal radius and be arranged such that the side walls are equispaced from each other.

The container may be for an elongate electronic nicotine delivery system and the body of the container is a rigid elongate body which defines the chamber including an end and an insert received in said end having a first opening and an ancillary opening that each lead into the chamber, the insert including a dividing wall to separate the first and ancillary openings in the insert so that an elongate electronic nicotine delivery system inserted into the chamber through said first opening protrudes therefrom and is supported in an upright position within the chamber by said insert, the lid being pivotable so that it covers said first and ancillary openings in the insert in a closed position.

The container may further comprise a pin that attaches the lid to the body for rotation about the longitudinal axis of the pin that extends between the opposing side walls, wherein the pin is also positioned so that it lies between the opposing end walls.

In accordance with embodiments, there is also provided a container for an electronic nicotine delivery system or other flavored vapor delivery system comprising a body defining a chamber having an end with an opening therein for insertion of an electronic nicotine delivery system through said opening into the chamber, wherein said end of the body is shaped so as to define a recess and said opening is formed in said recess in the end of the body.

The recess may be located centrally on the end of the chamber.

The recess may be curved.

In accordance with embodiments, there is also provided a container for an electronic nicotine delivery system or other flavored vapor delivery system comprising a body defining a chamber having an end with an opening therein for insertion of an electronic nicotine delivery system through said opening into the chamber, and a lid having a side wall with an edge, the lid being pivotally attached to the body so that said edge contacts said end of the body when the lid is in a closed position, wherein the edge has an outwardly protruding region which extends towards the body when the lid is in a closed position.

The end of the body may be shaped so as to define a recess and said opening is formed in the recess in the end of the body, and wherein the protrusion of the lid is shaped to match the recess in the end of the body so that the lid extends into said recess in a closed position.

The container may be for an elongate electronic nicotine delivery system and the body of the container is a rigid elongate body and an insert is received in said end of the chamber, said insert having a first opening and an ancillary opening that each lead into the chamber, the insert including a dividing wall to separate the first and ancillary openings in the insert so that an elongate electronic nicotine delivery system inserted into the chamber through said first opening protrudes therefrom and is supported in an upright position within the chamber by said insert, the lid being pivotally attached to said body so that it covers said first and ancillary openings in the insert in a closed position.

The body may comprise opposing side walls separated by end walls at a peripheral edge of each side wall and a pin that attaches the lid to the body for rotation about the longitudinal axis of the pin that extends between the opposing side walls, wherein the pin is also positioned so that it lies between the end walls.

The container lid and the body may each have a pair of opposing side walls separated by opposing end walls, wherein said opposing side walls of said body and said lid are arcuate in shape.

In accordance with embodiments, there is also provided a container for an elongate electronic nicotine delivery system or other flavored vapor delivery system, the container comprising a rigid elongate body defining a chamber including an end having an opening so that an elongate electronic nicotine delivery system inserted into the chamber through said opening is supported in an upright position within the chamber, a lid pivotally attached to said body to cover said opening in a closed position, and an over-center biasing mechanism configured to bias the lid toward a closed position until the lid has been pivoted into an intermediate position, beyond which the lid is biased towards an open position.

The over-center biasing mechanism may comprise a cam member and a cooperating cam element on the lid, the cam member being biased into contact with the cam element by a resilient member so that the lid pivots against the biasing force of the resilient member.

The cam element of the lid may comprise first and second surfaces disposed at an angle to each other such that said cam member acts against the first surface to bias the lid towards a closed position and, after the lid is pivoted into an intermediate position, the cam member acts against the second surface to bias the lid towards an open position.

The cam member may comprise a protrusion on a surface of said cam member that contacts said cam element of said lid, said protrusion configured to interact with an edge between the first and second surfaces of the cam element to generate an audible sound as the edge moves over said protrusion during rotation of said lid.

The container may comprise an insert received in the end of the chamber.

The insert may comprise a first opening and an ancillary opening that each lead into the chamber and a dividing wall to separate the first and ancillary openings in the insert so that an elongate electronic nicotine delivery system inserted into the chamber through said first opening protrudes therefrom and is supported in an upright position within the chamber by said insert.

The body may comprise opposing side walls separated by end walls at a peripheral edge of each side wall and a pin that attaches the lid to the body for rotation about the longitudinal axis of the pin that extends between the opposing side walls, wherein the pin is also positioned so that it lies between the end walls.

The lid and the body may each have a pair of opposing side walls separated by opposing end walls to define a chamber to receive an electronic nicotine delivery system, wherein said opposing side walls of said body and said lid are arcuate in shape.

The end of the chamber may be shaped so as to define a recess and said opening may be formed in said recess in the end of the body.

The lid may have a side wall with an edge which contacts the end of the body when the lid is in a closed position, and wherein the edge has an outwardly protruding region which extends towards the body when the lid is in a closed position.

The container may further comprise a switch for detecting whether the lid is in an open or closed position. The switch may be mechanically operated by movement of the lid for detecting whether the lid is in an open or closed position. The container may include electronic and/or electrical functionality which is controlled in accordance with the open or closed position of the lid as detected by the switch.

In accordance with embodiments, there is also provided a container for an electronic nicotine delivery system or other flavored vapor delivery system, said container comprising an elongate body defining a chamber therein having an end, said end comprising first and second openings, wherein each of said first and second openings are configured to separately support an elongate electronic nicotine delivery system inserted through each of said first and second openings an upright position in the chamber.

Each of said first and second openings may be tubular.

An insert may be received in said end of the chamber and said first and second openings are formed in the insert.

The insert may include a dividing wall separating the first and second openings.

The insert may further comprise an ancillary opening to receive an ancillary article or articles in addition to said first and second openings.

The ancillary opening may merge with at least one of the first and second openings.

The container may further comprise a lid being pivotally attached to said body so that it covers said first and second openings in a closed position, wherein said lid comprises a hinge member that extends from the lid into a hinge recess formed in the insert and a pin extends through a part of the body and the hinge member to pivotally mount the lid to the body about a longitudinal axis of the pin.

The hinge recess may be disposed on one side of the body and at least one of said first and second openings is disposed on an opposite side of the body to the hinge recess.

The ancillary opening may be disposed between the hinge recess and at least one of the first and second openings.

The ancillary opening may be disposed between the hinge recess and both of the first and second openings.

The lid may comprise a rib that extends from a surface of the lid and is arranged to retain an electronic nicotine delivery system received in the first or second opening when the lid is closed.

The container may further comprise an over-center biasing mechanism configured to bias the lid toward a closed position until the lid has been pivoted into an intermediate position, beyond which the lid is biased towards an open position.

The body may comprise opposing side walls separated by end walls at a peripheral edge of each side wall and the pin that attaches the lid to the body for rotation about extends between the opposing side walls, wherein the pin is also positioned so that it lies between the end walls.

The lid and the body may each comprise a pair of opposing side walls separated by opposing end walls to define a chamber to receive an electronic nicotine delivery system, wherein said opposing side walls of said body and said lid are arcuate in shape.

The end of the chamber may be shaped so as to define a recess and at least one of said first and second openings is formed in said recess in the end of the body.

The lid may have a side wall with an edge which contacts the end of the body when the lid is in a closed position, and wherein the edge has an outwardly protruding region which extends towards the body when the lid is in a closed position.

The lid may comprise a thumb wheel which is coaxial with an axis of rotation of the lid, said thumb wheel being disposed such that a user is able to contact said thumb wheel to rotate the lid.

The thumb wheel may be substantially cylindrical having an outer face having a groove which a user can contact to rotate said thumb wheel.

The body may comprise a curved region, disposed below the thumb wheel, where the side wall of the body is curved inwards.

A top wall of the lid may comprise a lip such that a user is able to push on the lip to rotate the lid into an open position.

The container may comprise a polycarbonate material.

The polycarbonate material may be at least partly transparent.

An electronic nicotine delivery system or other flavored vapor delivery system may be received in the chamber through said opening.

The electronic nicotine delivery system may be an electronic cigarette.

The containers disclosed herein may be used not just for holding an electronic nicotine delivery system such as an electronic cigarette, but also any other type of flavored vapor delivery system (electronic or otherwise; nicotine or otherwise).

BRIEF DESCRIPTION OF THE DRAWINGS

Embodiments will now be described, by way of example only, with reference to the accompanying drawings, in which.

DETAILED DESCRIPTION

Figure 1:
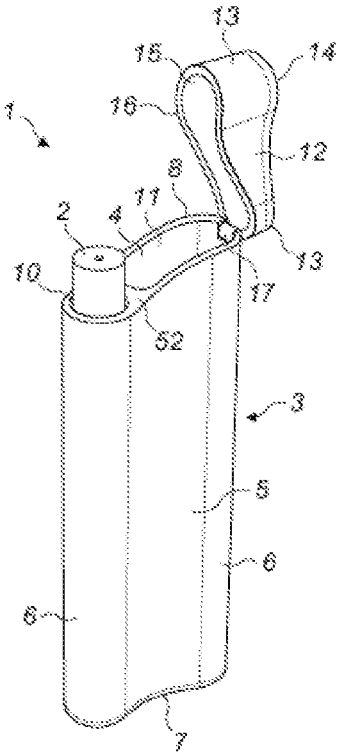
FIG. 1 shows an example of a container for an electronic cigarette.

FIG. 1 shows an example of a container 1 for holding an electronic nicotine delivery system, such as an electronic cigarette 2, or other flavored vapor delivery system. The container 1 has an elongate rigid body 3 with an internal chamber 4 defined within side walls 5 and end walls 6 which are joined in a tubular manner, with a base wall 7 that closes one end of the elongate tubular body 3. At an opposite end of the elongate body 3 to the closed base wall 7 the body 3 has an open end 8 to provide access to the chamber 4. The container 1 also has a lid 9 which is hingedly attached to the body 3 so that the lid 9 can be closed to cover the open end 8, or opened to expose the open end 8 and provide access to the chamber 4. In this example, the open end 8 has a first opening 10 and an ancillary opening 11 which lead into the chamber 4 within the body 3. The first opening 10 is for receiving an electronic cigarette 2 and the ancillary opening 11 is for an ancillary article or articles (not shown), which may, for example, be another electronic cigarette and/or an information leaflet.

The container described with reference to FIG. 1 has a generally rectangular tubular body 3 consisting of two side walls 5 and two end walls 6 and the lid 9 is formed in a similar manner. However, it will be appreciated that other shapes of container can also be used. For example, the container may have a generally triangular tubular shape, or be formed of two curved side walls with a space between them. Therefore, embodiments are not limited to only rectangular tubular containers and applies to all forms. For convenience, the examples of containers described herein have a rectangular tubular construction, as described with reference to FIG. 1.

A supporting wall 52 extends across the chamber 4 within the body 3 to divide the chamber 4 into the first opening 10 and the ancillary opening 11. The supporting wall 52 may extend at least partially into the chamber 4 from the open end 8 towards the base wall 7 so that the first opening 10 is formed in a region of the chamber 4 extending from the open end 8 at least partially into the chamber 4, with the remaining space between the first opening 10 and the base wall 7 being open so that an electronic cigarette can be received in the first opening 10 and at least partially supported. Alternatively, the supporting wall 52 may not extend from the open end 8. In this case, the supporting wall 52 and the first opening 10 may be disposed within the chamber 4 between the open end 8 and the base wall 7. Alternatively, the supporting wall 52 and therefore the first opening 10 may extend for the length of the chamber 4, from the open end 8 to the base wall 7.

In this example, the first opening 10 has a circular shape such that it can receive an elongate cylindrical electronic cigarette 2. The diameter of the first opening 10 is slightly larger than the diameter of the electronic cigarette 2 so that the electronic cigarette 2 can be inserted into and removed from the first opening 10 which will support the electronic cigarette 2 and limit movement within the opening. However, it will be appreciated that the first opening 10 may have a non-circular cross-section, for supporting other shapes of electronic nicotine delivery systems.

In the example shown in FIG. 1, the ancillary opening 11 comprises the remainder of the chamber 4 within the body 3 that is not occupied by the first opening 10. The ancillary opening 11 is provided for ancillary articles, for example an information leaflet or a refill part for the electronic cigarette 2. The ancillary opening 11 extends from the open end 8 into the chamber 4 and may extend partially towards the base wall 7 to a wall (not shown) which is provided in the body 3 and forms the bottom of the ancillary opening 11. Alternatively, the ancillary opening 11 may extend the length of the chamber 4 so that the base wall 7 defines the bottom of the ancillary opening 11. The ancillary opening 11 and first opening 10 are at least partially separated by the supporting wall 52, but the wall 52 may not extend the length of the chamber 4 so the openings 10, 11 may not be entirely separated. However, the separating wall 52 will separate and support an electronic cigarette and an ancillary article received in the chamber.

The lid 9 of the container 1 shown in FIG. 1 comprises two side walls 12 and two end walls 13 formed in a tubular manner, similar to the body 3. The lid 4 has a top wall 14 such that a second chamber 15 is defined within the lid 9, which has an open face 16 that abuts against the open end 8 of the body 3 when the lid 9 is in a closed position. The exterior shape of the lid 9 matches that of the body 3 of the container 1 so that the lid 9 is flush with the body 3 and the container has a constant and smooth exterior surface when the lid is closed.

Figure 2:
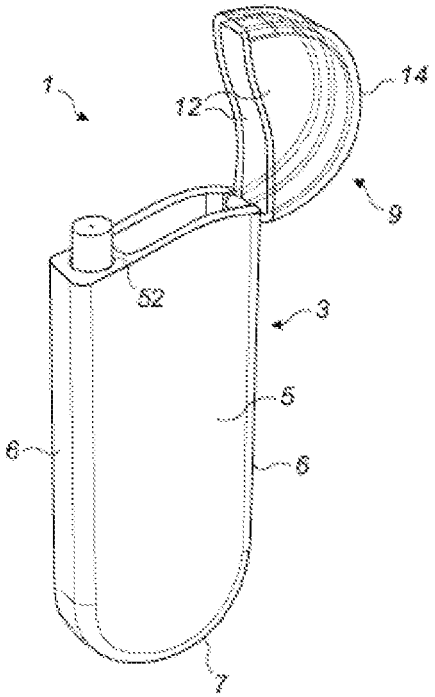
FIG. 2 shows another example of a container for an electronic cigarette.

As shown in FIG. 1, the closed base wall 7 of the body 3 and the top wall 14 of the lid 9 may be flat such that the ends of the container 1 are flat. Alternatively, as shown in FIG. 2, the closed end wall 7 of the body 3 and the top wall 14 of the lid 9 may be curved so that the container 1 has rounded ends. It will appreciated that the shape of the closed base wall 7 of the body 3 and the top wall 14 of the lid 9 may be any shape that is convenient for a user to hold or use the container. As shown in FIG. 1, the side faces 5 of the body 3 and the side faces 12 of the lid 9 may be non-planar, such that the container 1 has curved sides, which may make the container 1 more comfortable for a user to hold or use.

For example, as shown in FIG. 1, the opposing side walls 5 of the body may have an arcuate shape, such that the container has a generally concave appearance on one side and generally convex on the other. As shown in FIG. 1, the opposing side walls 5 may each have an arcuate shape with the same radius and arranged in the same direction such that the side walls 5 are equispaced from each other. The end walls 6 join the side walls 5 to form the tubular body 3 and the end walls 6 may be rounded, as shown in FIG. 1. The shape of the lid 9 may be similar to the shape of the body 3. The curved shape of the container may be advantageous when the container 1 is placed in the pocket of a user as the shape has no sharp edges and the shape of the container is comfortable against the leg or other part of the user. The arcuate shape of the container also makes it comfortable and easy to hold while opening and closing the lid.

Alternatively, as shown in FIG. 2, the side walls 5 of the body 3 and the side walls 12 of the lid 9 may be planar such that the container has flat sides.

Figure 3A:
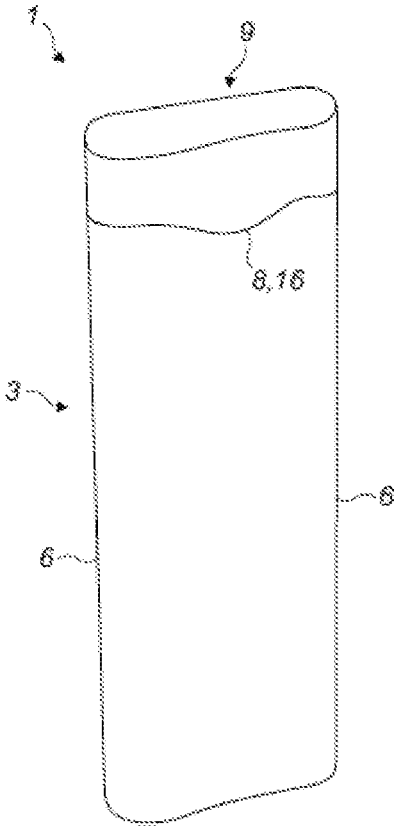
FIG. 3*a* shows a further example of a container for an electronic cigarette with the lid closed.
Figure 3B:
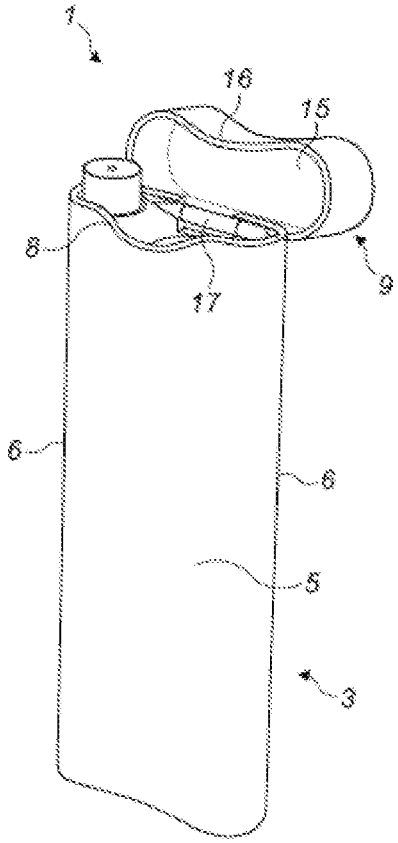
FIG. 3*b* show the example container of FIG. 3*a*, with the lid open.

The lid 9 of the container 1 of FIG. 1 is hingedly mounted to the body 3 so that it closes the open end 8 of the chamber 4 and encloses the first opening 10 and the ancillary opening 11. As shown in FIG. 1, the lid 9 is mounted on a hinge 17 which is located on the open end 8 of the body 3. The hinge 17 may be disposed on an end wall 6 of the body 3, as shown in FIG. 1, or it may be disposed on a side wall 5 of the body, as shown in FIGS. 3*a* and 3*b*. The open face 16 of the lid 9 is shaped to match the open end 8 of the body 3 so that, when the lid is closed the lid 9 is flush with the body 3 and there is no gap between them, giving the exterior of the container 1 a constant and smooth exterior shape, as shown in FIG. 3*a*.

FIGS. 1 and 3*b* show that the second chamber 15 within the lid 9 extends from the open face 16 into the lid 9 so that the second chamber 15 forms an extension of the chamber 4 of the body 3 when the lid 9 is in a closed position. Therefore, an electronic cigarette 2 or ancillary article received in the chamber 4 will be able to protrude past the open end 8 of the body 3 into the second chamber 15 within the lid 9 when the lid 9 is closed.

The hinge 17 which pivotally joins the body 3 and the lid 9 may comprise a pin which extends through a part of the body 3 and a part of the lid 9. For example, a part of the body 3 and a part of the lid 9 may comprise holes through which the pin extends. The lid 9 may comprise a lug that extends into the chamber 4 so that it is disposed between the side faces 5 or end faces 6 of the body 3, the lug and the faces of the body 3 having holes for a pin which pivotally mounts the lid 9 to the body 3. The hinge 17 may further include a biasing member, such as a torsion spring, that acts to bias the lid into a closed position. Alternatively, the hinge 17 may not have a torsion spring and the lid may be freely rotatable.

As shown in FIG. 1, the first opening 10 of the body 3 supports the electronic cigarette 2 in an upright position such that an end portion of the electronic cigarette 2 protrudes from the first opening 10 above the open end 8 of the chamber 4. That is, the first opening 10 in the chamber 4 is not as long as the electronic cigarette 2. In this way, when the lid 9 is open a user can easily grasp the protruding end of the electronic cigarette 2 to remove the electronic cigarette from the container 1. When the lid 9 is in the closed position, the protruding portion of the electronic cigarette 2 will be disposed in the second chamber 15 within the lid 9 and will not obstruct the opening and closing movement of the lid 9.

Also, as shown in FIG. 1, the open end 8 of the body 3 and the open face 16 of the lid 9 may be shaped such that the hinge 17 and the first opening 10 are at different levels, with the open end 8 in the region of the first opening 10 being disposed at a lower level, closer to the base wall 7 of the body 3, than the open end 8 in the region of the hinge 17. Therefore, the amount of the electronic cigarette 2 that protrudes from the main body 3 can be increased to further ease insertion and removal of the electronic cigarette 2 without obstructing the movement of the lid 9.

The open end 8 of the body 3 and the open face 16 of the lid 9 may have a non-planar, curved profile, as shown in the example of FIG. 1. Alternatively, the open end 8 of the body 3 and the open face 16 of the lid 9 may be planar and angled downwards such that the open end 8 is lower, and closer to the base wall 7, in the region of the first opening 10 than in the region of the hinge 17.

Alternatively, as shown in FIGS. 3*a* and 3*b*, the open end 8 of the body 3 and the open face 16 of the lid 9 may be shaped such that in the region of the first opening 10 and in the region of the hinge 17 the open end 8 is at the same level and therefore equidistant to the base wall 7. In this case, the open end 8 of the body may be shaped such that it is at a lower level in the vicinity of the ancillary opening 11. That is, the open end 8 comprises a curved recess and the open end 8 is closer to the base wall 7 in the region of the recess. In this example, the recess is disposed in the vicinity of the ancillary opening 11 so that removal and insertion of ancillary articles is made easier.

Alternatively, the open end 8 of the body 3 and the open face 16 of the lid 9 may have a recess disposed such that the open end 8 in the region of both the end of the first opening 10 and the end of the ancillary opening 11 is at a lower level and closer to the base wall 7 than the hinge 17. In this way, insertion and removal of articles to and from the first opening 10 and the ancillary opening 11 is made easier. As shown in FIGS. 3*a* and 3*b*, the lid 9 extends into the recess in the open end 8 so that the lid 9 closes the open end 8 of the chamber. In this example, the recess has a curved shape, although it will be appreciated that the recess may have any shape.

In the example shown in FIG. 1, the first opening 10 for receiving an electronic cigarette 2 is positioned at on opposite side of the chamber 4 to the hinge 17. That is, the hinge 17 is located on an edge of one end wall 6 and the first opening 10 is located adjacent to the opposite end wall 6 of the body 3. The positions of the first opening 10 and the ancillary opening 11 within the chamber 4 are determined by the position of the supporting wall 52 that extends at least partially through the chamber 4. This means that when the lid 9 is in an open position an electronic cigarette 2 in the first opening 10 is spaced from the lid 9 and therefore easier for a user to grasp and remove. In this example, the ancillary opening 11 is formed in the part of the chamber 4 between the first opening 10 and the end wall 6 to which the hinge 17 is mounted.

It will be appreciated that the first opening 10 and ancillary opening 11 within the chamber 4 may be arranged differently to that described with reference to FIG. 1. For example, the supporting wall 52 may be disposed such that the first opening 10 is located centrally within the chamber 4 with the ancillary opening 11 being divided into two parts disposed on either side of the first opening 10. Alternatively, the first opening 10 may be formed against the end wall 6 to which the hinge 17 is attached, with the ancillary opening 11 occupying the remainder of the chamber 4.

The body 3 and lid 9 of the example containers shown in FIGS. 1, 2, 3*a* and 3*b* each have a substantially tubular construction. The body 3 has two side walls 5 and two end walls 6 which form a tubular shape with the chamber 4 formed within the tubular body 3. In the example shown in FIG. 1, the side walls 5 are longer than the end walls 6 such that the tubular body 3 and lid 9 have a generally rectangular cross-section. The base wall 7 closes one end of the chamber 4 so that the open end 8 provides the only access to the chamber 4.

The edges between the side walls 5 and the end walls 6 may be rounded, as shown in FIG. 1, alternatively, they may be square.

Figure 4A:
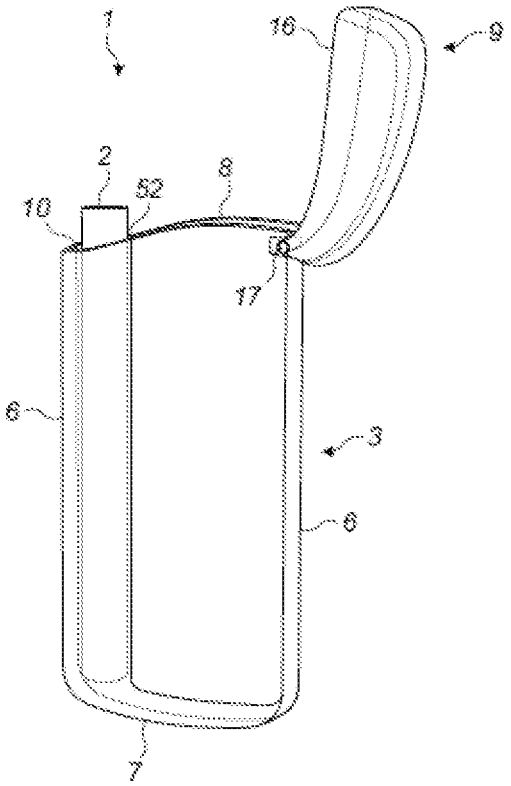
FIG. 4*a* shows another example of a container for an electronic cigarette, with the lid open.
Figure 4B:
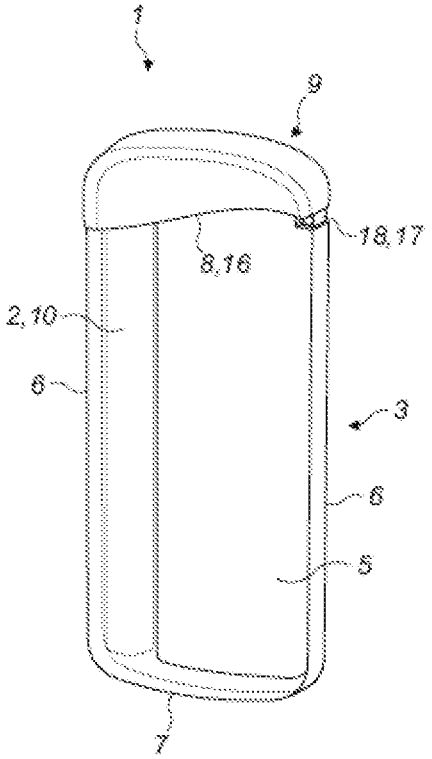
FIG. 4*b* shows the example container of FIG. 4*a*, with the lid closed.

FIGS. 4*a* and 4*b* show another example of a container 1 for an electronic cigarette 2 having a rigid tubular body 3 and a lid 9 similar to those described with reference to FIG. 1. In these examples, the open face 16 of the lid 9 and the open end 8 of the body 3 have a curved shape. Specifically, the open face 16 of the lid 9 and the open end 8 of the body 3 have an inflexed curve shape, with the open end 8 of the body 3 in the region of the end wall 6 to which the hinge 17 is attached being at a higher level, further from the base wall 7, than the open end 8 in the region of the first opening 10 formed by the supporting wall 52. In this way, an electronic cigarette 2 received in the first opening 10 will protrude from the end of the first opening 10, above the open end 8 of the body 3, so that a user can easily grasp the end of the electronic cigarette 2 for removal and insertion when the lid 9 is open. Furthermore, the rotation of the lid is not impeded by the protruding electronic cigarette 2.

As shown in FIG. 4*b*, the hinge 17 which provides the pivot connection between the lid 9 and the body 3 is formed of a lug 18 that extends from the lid 9. The lug 18 extends towards the base wall 7 in a direction along the end wall 6 of the body 3, which has a cut-out to receive the lug 18. The opposing side faces 5 of the body 3 comprise coaxial holes in the vicinity of the cut-out and the lug 18 also comprises a hole such that a pin can extend through the holes in the side walls 5 of the body 3 and the lug 18 to pivotally mount the lid 9 to the body 3.

The size of the cut-out in the end wall 6 of the body 3 and the lug 18 can be selected so that the lid 9 has a fixed maximum opening angle. For example, as shown in FIG. 4*a*, the lid 9 may open to a maximum of 100 degrees from the closed position, which provides sufficient access to the first and ancillary openings 10, 11 of the chamber 4 through the open end 8 of the body 3. However, it will be appreciated that a greater or smaller maximum opening angle may be created by altering the size of the cut-out and lug 18. At the maximum opening angle a part of the lug 18 will abut against an edge of the cut-out in the body 3 to prevent further rotation of the lid 9.

Figure 5A:
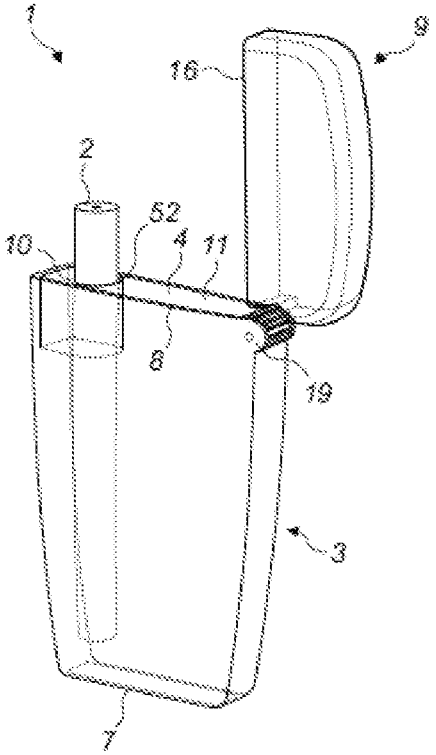
FIG. 5*a* shows another example of a container for an electronic cigarette, with the lid in an open position.
Figure 5B:
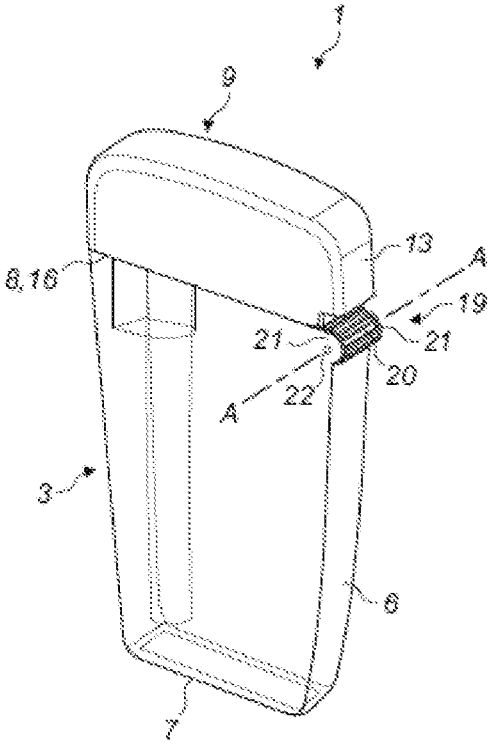
FIG. 5*b* shows the example container of FIG. 5*a*, with the lid in a closed position.
Figure 5C:
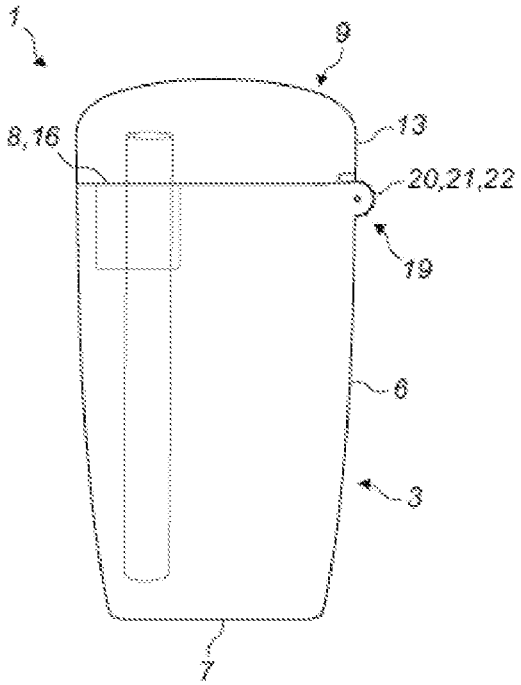
FIG. 5*c* shows a side view of the example container of FIGS. 5*a* and 5*b*, with the lid in a closed position.

FIGS. 5*a* to 5*c* show another example of a container 1 for an electronic cigarette 2. The container 1 of this example has a body 3 and lid 9 which are similar to the examples described with reference to FIG. 1. In particular, the body 3 comprises a chamber 4 which includes a supporting wall 52 to divide the chamber 4 into a first opening 10 for receiving and supporting an electronic cigarette 2 and an ancillary opening 11 for an ancillary article. As shown in FIGS. 5*a* to 5*c*, the open face 16 of the lid 9 and the open end 8 of the body 3 are planar and parallel to the base wall 7.

In this example, a hinge 19 is formed between one end wall 6 of the body 3 and one end wall 13 of the lid 9 to pivotally attach the lid 9 to the body 3. As shown in FIGS. 5*b* and 5*c*, the hinge 19 includes a thumb wheel 20 which extends from the lid 9 and two spaced parallel flanges 21 that extend from the body 3. The thumb wheel 20 and the parallel flanges 21 extend from the side of the container 1 in line with the open end 8 of the body 3 when the lid 9 is closed, as shown in FIG. 5*c*. The thumb wheel 20 has a substantially cylindrical shape and is disposed such that a longitudinal axis of the thumb wheel 20 is coaxial with the rotational axis A-A (see FIG. 5*b*) of the lid 9. The spaced parallel flanges 21 extend from the body 3 in the same location as the thumb wheel 20 extending from the lid 9, such that the thumb wheel 20 is disposed between the spaced parallel flanges 21. Each of the spaced parallel flanges 21 and the thumb wheel 20 comprise holes that are coaxially aligned such that a pin 22 can extend through the holes to pivotally mount the lid 9 to the body 3 about an axis A-A that is co-axial to the cylindrical thumb wheel 20.

As shown in FIG. 5*c*, the thumb wheel 20 of the lid 9 protrudes from the side of the container 1 in line with the open end 8 of the body 3 when the lid 9 is in a closed position, such that the outer circumferential face of the cylindrical thumb wheel 20 can be contacted by a user of the container 1. In this example, as shown in FIG. 5*b*, the outer circumferential face of the thumb wheel 20 is provided with a plurality of grooves. These grooves provide a user with sufficient grip to rotate the thumb wheel 20 relative to the parallel flanges 21 and thereby rotate the lid 9 into an open position. The thumb wheel 20 may also have a greater diameter than the parallel flanges 21 so that the thumb wheel 20 is easier for a user to contact and rotate.

In particular, the arrangement of the thumb wheel 20 and mounting flanges 21 allows a user to hold the container 1 in one hand and contact and rotate the thumb wheel 20 with a finger or thumb of the same hand, so that the container 1 can be held and opened using a single hand. Alternatively, the user may use two hands to rotate the thumb wheel 20 or may grip another part of the lid 9 to rotate the lid 9 into an open position.

The thumb wheel 20 and the spaced parallel flanges 21 in the body 3 may be arranged to define the maximum opening angle of the lid 9. For example, the thumb wheel 20 and spaced parallel flanges may be arranged such that they contact at a rotational angle of 100 degrees from the closed position and prevent further rotation.

The thumb wheel 20 described with reference to FIGS. 5*a* to 5*c* may be formed of a solid cylindrical protrusion. Alternatively, the thumb wheel 20 may be formed of two spaced parallel circular flanges. The thumb wheel 20 may be provided with grooves or any kind of surface pattern that allows a user to grip the thumb wheel 20 for rotation, for example knurling.

Figure 6A:
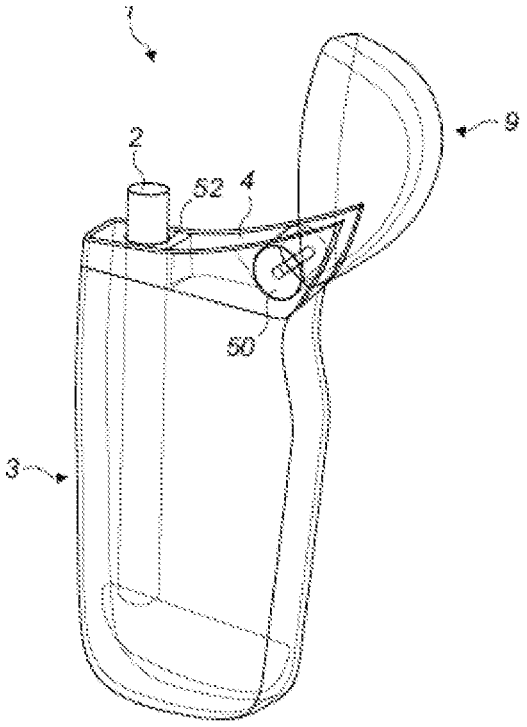
FIG. 6*a* shows yet another example of a container for an electronic cigarette, with the lid open.
Figure 6B:
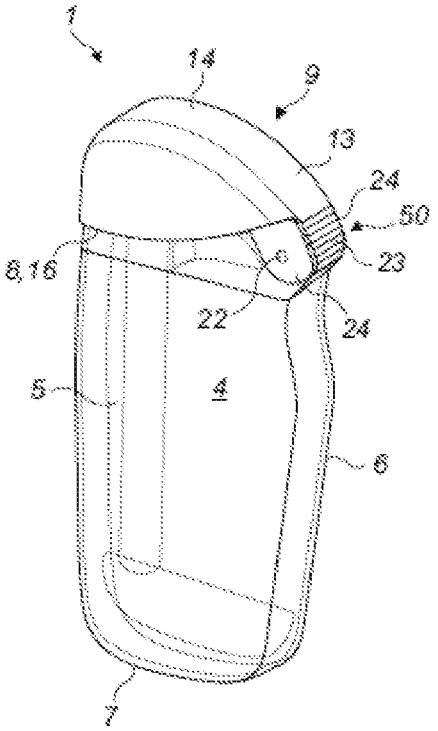
FIG. 6*b* shows the example container of FIG. 6*a*, with the lid in a closed position.
Figure 6C:
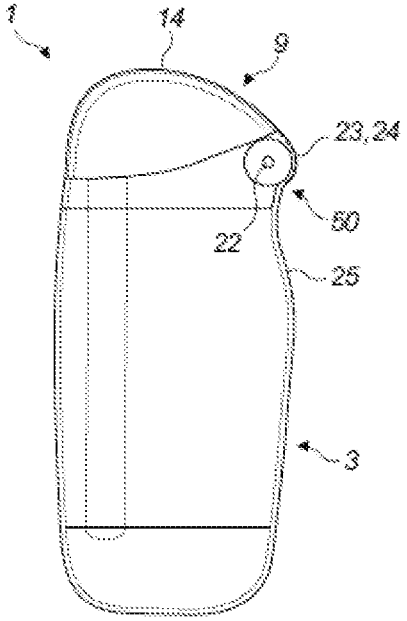
FIG. 6*c* shows a side view of the example container of FIGS. 6*a* and 6*b*, with the lid in a closed position.

FIGS. 6*a*, 6*b* and 6*c* show another example of a container 1 for an electronic cigarette 2. This example container 1 has a body 3 and a lid 9 similar to those described with reference to FIG. 1. In particular, the container has a rigid tubular body 3 with a chamber 4 that has a supporting wall 52 that divides the chamber 4 into a first opening for supporting an electronic cigarette 2 in an upright position and an ancillary opening 11 to receive ancillary articles.

In this example, as shown in FIG. 6*b*, a hinge 50 is formed between the body 3 and the lid 9. The hinge 50 is formed of a thumb wheel 23 that extends from the lid 9 and two hinge mounting portions 24 that are formed in the side walls 5 of the body 3. The end wall 6 of the body 3 is provided with a cut-out in the vicinity of the thumb wheel 23 so that the thumb wheel 23 can be received between the hinge mounting portions 24 of the side walls 5, within the chamber 4. The thumb wheel 23 is substantially cylindrical and the mounting portions 24 and thumb wheel 23 all comprise holes that are coaxial with each other such that a pin 22 can extend through the holes and the chamber 4 in the region between the hinge mounting portions 24 to pivotally mount the lid 9 to the body 3. In this example the pin 22 is positioned between the end walls 6 of the body 3 so that the hinge 50 is formed within the exterior outline of the container and no part protrudes from a side of the container.

An outer surface of the thumb wheel 23 is provided with a plurality of grooves that allow a user to grip and rotate the thumb wheel 23 and thereby open the lid 9. In particular, the arrangement of the thumb wheel 23 and hinge mounting portions 24 allows a user to hold the container 1 in one hand and contact and rotate the thumb wheel 23 with a finger or thumb of the same hand, so that the container can be held and opened using a single hand. Alternatively, the user may use two hands to rotate the thumb wheel 23 or may grip another part of the lid 9 to rotate the lid 9 into an open position.

The thumb wheel 23 described with reference to FIGS. 6*a* to 6*c* may be formed of a solid cylindrical protrusion. Alternatively, the thumb wheel 23 may be formed of two spaced parallel circular flanges that extend from the side walls of the lid 9. The thumb wheel 23 may be provided with grooves or any kind of surface pattern that allows a user to grip the thumb wheel 23 for rotation, for example knurling.

Furthermore, the top wall 14 of the lid 9 of the container described with reference to FIGS. 6*a* to 6*c* may be tapered and curved towards the thumb wheel 23, as shown in FIG. 6*c*, such that a user is able to easily move their finger or thumb across the top wall 14 of the lid 9 and contact the thumb wheel 23 to open the lid 9.

To aid the rotational movement of the thumb wheel 23 by a user, the end wall 6 of the body 3 of the container 1 to which the hinge 50 is mounted may have a curved region 25 disposed beneath the thumb wheel 23, as shown in FIG. 6*c*. This provides more space for the user's finger to move into as the thumb wheel 23 and lid 9 are rotated into the open position and makes the lid opening action easier to perform. This curved region 25 may also make the container 1 more comfortable for a user to hold.

The thumb wheel 23, cut-out and hinge mounting portions 24 in the body 3 may be arranged to define a maximum opening angle of the lid 9. For example, the thumb wheel 23 and body 3 may interact such that the thumb wheel 23 contacts a part of the body 3 after a rotation of 100 degrees from the closed position, thereby defining the maximum opening position of the lid 9. However, it will be appreciated that other opening angles may be more appropriate, for example, 90 degrees, 110 degrees or other angles.

Figure 7A:
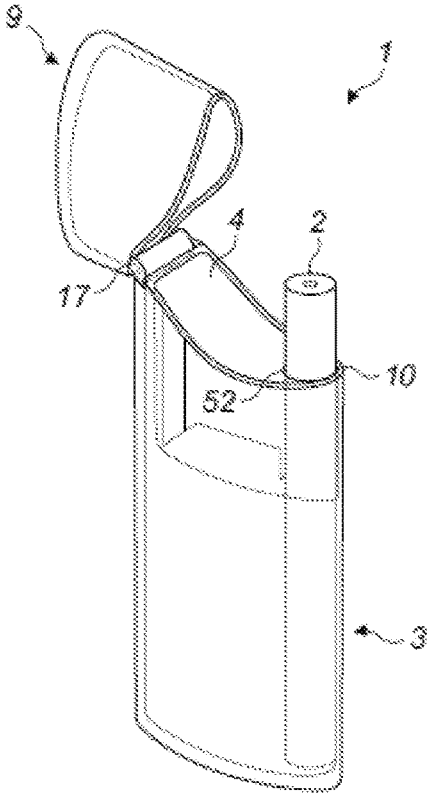
FIG. 7*a* shows a further example of a container for an electronic cigarette, with the lid in an open position.
Figure 7B:
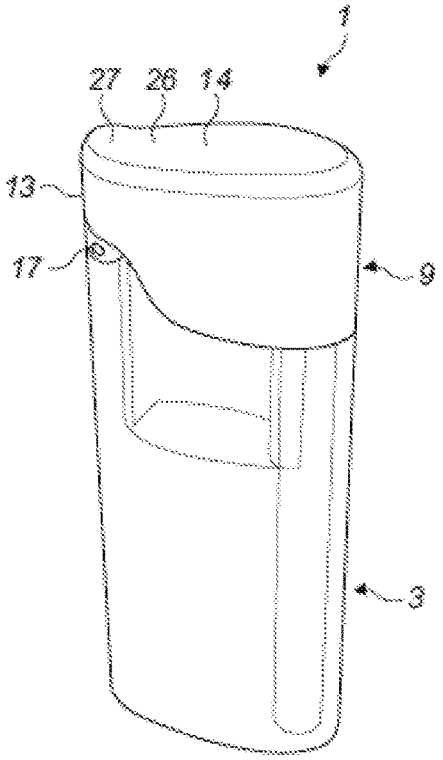
FIG. 7*b* shows the example container of FIG. 7*a*, with the lid in a closed position.
Figure 7C:
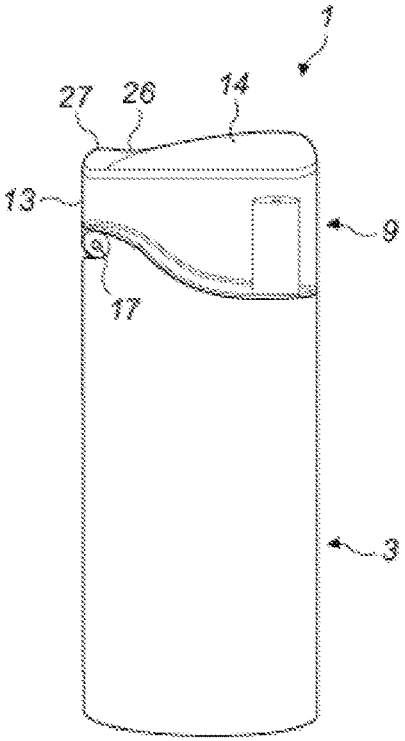
FIG. 7*c* shows a side view of the example container of FIGS. 7*a* and 7*b*, with the lid in a closed position.

FIGS. 7*a* to 7*c* show another example of a container 1 for an electronic cigarette 2. This example has a body 3 and a pivotally mounted lid 9 with a hinge 17 similar to the container described with reference to FIG. 1. The body 3 has a chamber 4 with a supporting wall 52 that divides the chamber 4 into a first opening 10 for supporting an electronic cigarette 2 in an upright position and an ancillary opening 11 for an ancillary article.

In this example, as shown in FIGS. 7*b* and 7*c*, the top wall 14 of the lid 9 comprises a depression 26 which is located towards the hinge 17 end of the lid 9. The depression 26 forms a lip 27 which is disposed in the top wall 14 of the lid 9, towards the end wall 13 to which the hinge 17 is mounted. This lip 27 protrudes from the top wall 14 of the lid 9 and has a rounded point. When opening the lid 9, a user is able to grip the lid 9 by pushing on the lip 27 so that the lid 9 is rotated about the hinge 17 and the container 1 is opened. Therefore, a user is able to open the lid 9 by pushing on the lip 27 with a thumb or finger while holding the container. Advantageously, a user is able to hold the container 1 and open the lid 9 with one hand.

The shape of the depression 26 and the lip 27 allow a user to easily contact, grip and push the lid 9 in a downwards direction towards the body 3 and also backwards away from the lid 9 such that the lid 9 is caused to rotate about the hinge 17. It will be appreciated that the depression 26 and lip 27 may be located in any position on the top wall 14 of the lid 9, so long as pushing on the lip 27 will cause the lid 9 to pivot open.

Figure 8A:
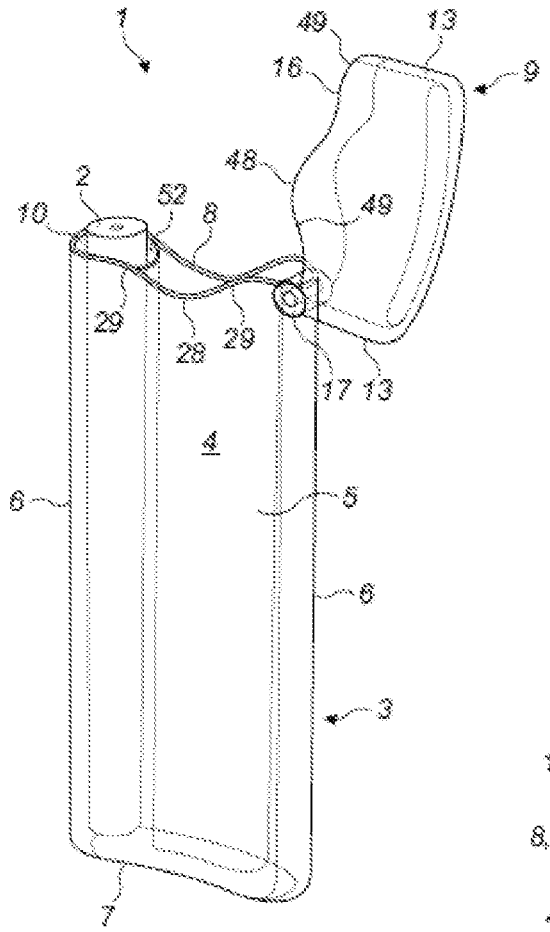
FIG. 8*a* shows another example of a container for an electronic cigarette, with the lid in an open position.
Figure 8B:
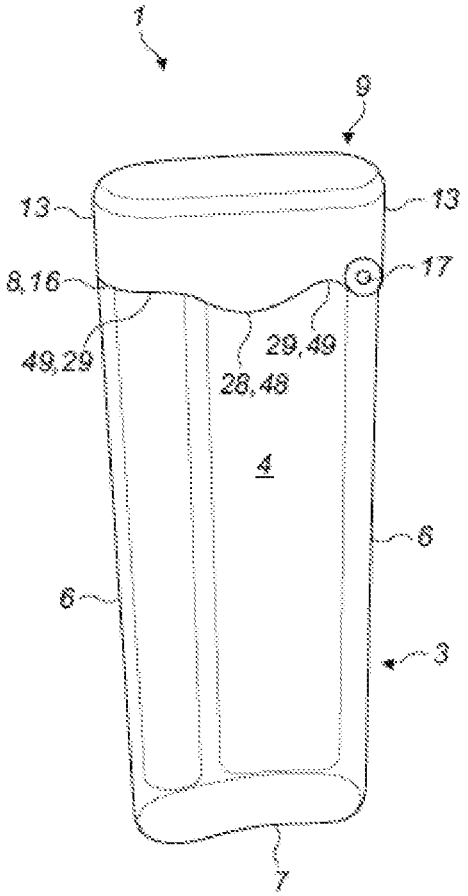
FIG. 8*b* shows the example container of FIG. 8*b*, with the lid in a closed position.

FIGS. 8*a* and 8*b* show another example of a container 1 for an electronic cigarette 2, comprising a body 3 and a lid 9 similar to that described with reference to FIG. 1. The rigid elongate body 3 has a chamber 4 which has a supporting wall 52 that divides the chamber 4 into a first opening 10 for supporting an electronic cigarette 2 in an upright position and an ancillary opening 11 for an ancillary article.

In this example, the open end 8 of the body 3 comprises a recess which defines a curved profile and the open face 16 of the lid 9 has a protrusion 48 that extends into that recess 28 when the lid is closed. In particular, the end portions 29 of the open end 8 of the body 3, which are closer to the end walls 6, are at the same level and same distance from the base wall 7. Centrally, between the end portions 29, the open end 8 has a recess 28, which in this example is curved, which extends towards the base wall 7 of the body 3. Similarly, the open face 16 of the lid 9 is provided with a curved protrusion 48 that extends from the open face 16 in the same manner as the recess 28 on the open end 8 of the body. The open face 16 of the lid 9 also has two aligned end portions 49 so that the shape of the open face 16 of the lid 9 and the open end 8 of the body 3 are matching and combine to leave no space between the lid 9 and the body 3 when the lid 9 is closed.

It will be appreciated that the curved recess of the open end 8 and open face 16 of the container 1 may be provided in the configuration shown in FIGS. 8*a* and 8*b* regardless of the arrangement of the first and ancillary openings 10, 11 in the body 3. For example, the first opening 10 may be positioned centrally within the chamber 4 and aligned with the curved region 28 of the open end 8 of the body 3.

It will also be appreciated that the recess 28 in the open end 8 of the body may be any shape and is not limited to only the curved shape shown in FIGS. 8*a* and 8*b*.

In the example shown in FIGS. 8*a* and 8*b*, the recessed open end 8 of the body 3 and the open face 16 of the lid 9 allow a user to more easily retrieve an ancillary article placed in the ancillary opening 11, between the first opening 10 and the hinge 19. This may be advantageous if the ancillary articles are more difficult to grasp than the electronic cigarette 2, especially if the ancillary article is shorter than the electronic cigarette 2 so would not otherwise protrude past the open end 8 of the body 3.

In another example, the first opening 10 is positioned in the center of the chamber 4, equispaced between the opposing end walls 6, and the recess 28 in the open end 8 of the body 3 is aligned with the centrally positioned first opening 10. Therefore, an electronic cigarette received in the first opening 10 is easily retrievable as the recess 28 allows a user to grasp more of the electronic cigarette 2.

The protrusion 48 on the lid 9, which extends towards the body 3, gives the lid a greater area on the side of the lid 9 so that a user can more easily grasp the lid 9 for closing and opening the container.

Figure 9A:
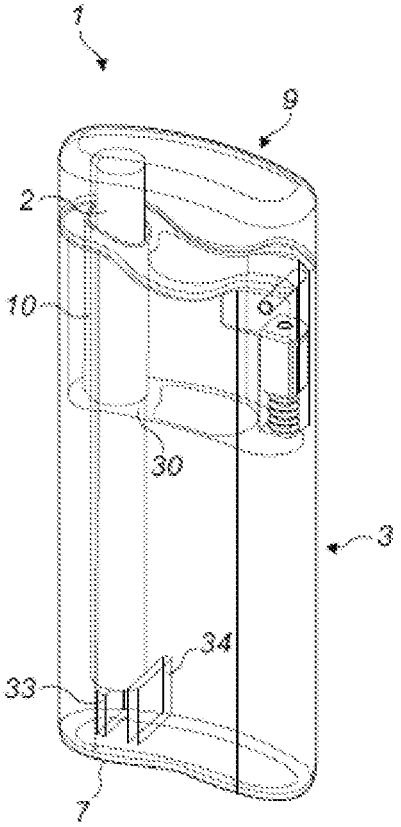
FIG. 9*a* shows another example of a container for an electronic cigarette.
Figure 9B:
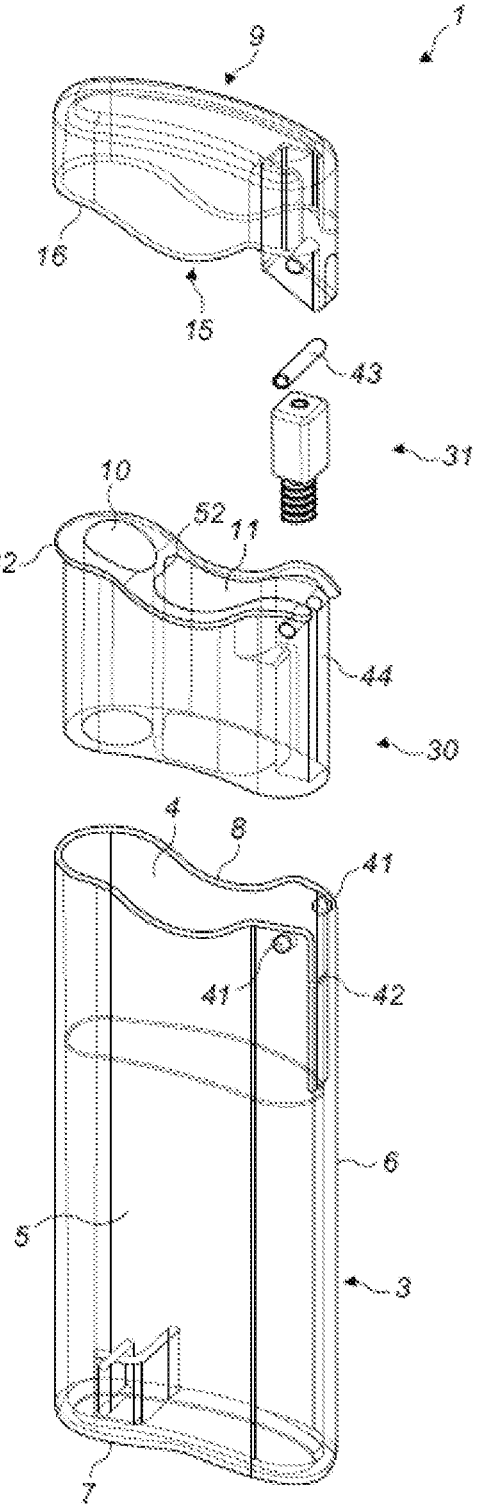
FIG. 9*b* shows an exploded assembly drawing of the example container of FIG. 9*a*.

FIGS. 9*a* and 9*b* show a further example of a container 1 for an electronic cigarette. FIG. 9*a* shows the container 1 when it is assembled with an electronic cigarette 2 received inside and FIG. 9*b* shows an exploded assembly drawing of the container 1. The container 1 of this example comprises a lid 9 and a body 3 which are similar to those described with reference to FIGS. 8*a* and 8*b*. However, in this embodiment, the container 1 comprises an insert 30 that is received within the chamber 4 of the body 3 and also comprises an over-center biased hinge 51 (see FIGS. 11*a* and 11*b*), as will be described below. However, as will become clear from the below description, the insert 30 and the over-center biased hinge 51 are independent of each other and either or both may be provided to any of the example containers described herein.

As shown in FIG. 9*b*, the container 1 comprises an insert 30 which includes the supporting wall 52 to form the first opening 10, which extends through the insert 30 and also the ancillary opening 11. The insert 30 is received in the open end 8 of the body 3 and a lip 32, which extends outwardly from the top of the insert 30, abuts against the open end 8 of the body so that the insert 30 is supported on the open end 8 within the chamber 4. The lip 32 of the insert 30 is shaped to match the shape of the open face 16 of the lid 9 and the open end 8 of the body 3, which in this example are shaped as described with reference to FIGS. 8*a* and 8*b*, with the open end 8 of the body having a curved recess into which the lid extends when the lid is closed.

The insert 30 shown in FIG. 9*b* extends partially into the chamber 4 within the body 3. However, it will be appreciated that the insert 30 may alternatively extend through the entire chamber 4 to the base wall 7 of the body 3. The first opening 10 which is formed in the insert 30 extends through the insert 30 so that it can receive an electronic cigarette 2 to support the electronic cigarette in an upright position within the chamber 4. However, the ancillary opening 11 formed in the insert 30 may not extend through the insert 30 and may instead be limited to the space within the insert 30. Alternatively, the ancillary opening 11 may extend through the entire insert 30 such that the ancillary opening 11 extends through the insert 30 to the base wall 7 of the body 3.

The insert 30 may be retained in the body 3 by means of a push-fit or interference fit between the outer surface of the insert 30 and the inner surface of the chamber 4. Alternatively, the insert 30 may be retained by the hinge pin 43 that extends through a pivot hole 30*a* in the insert 30 and also through the body 3. The body 3 may additionally comprise ribs or other protrusions that mate with grooves or depressions on the insert 30 to fix the position of the insert 30 within the body 3. Alternatively, the insert 30 may be adhered or welded to the body 3.

The insert 30 described with reference to FIG. 9*b* may be provided to any of the example containers described herein. The insert 30 may be advantageous as the first opening 10 and any other features can be formed within the insert 30 and not within the body 3, which makes the body 3 simpler and easier to manufacture.

Also shown in FIG. 9*a*, a stopper 33 may be located on the base wall 7 within the chamber 4. The stopper 33 is aligned with the first opening 10 in the insert 30 such that, when an electronic cigarette 2 is received in the container 1, an end of the electronic cigarette 2 abuts against the stopper 33. Therefore, the position of the electronic cigarette 2 within the container 1 is defined by the height and position of the stopper 33, the first opening 10 and the overall length of the body 3 compared to the length of the electronic cigarette 2. The height of the stopper 33 above the base wall 7 will determine the amount of the electronic cigarette 2 that protrudes past the open end 8 of the body 3 into the second chamber 15 of the lid. Also shown in FIG. 9*a*, a wall 34 may be provided adjacent to the stopper 33 to prevent the end of the electronic cigarette 2 from moving away from the stopper 33. As shown in FIG. 9*a*, the stopper 33 may comprise a cross-shaped protrusion on the base wall 7. Alternatively, the stopper 33 may be any shape or configuration of protrusion against which the electronic cigarette 2 will abut.

Alternatively, the stopper 33 may comprise a resilient material (not shown) disposed in the bottom of the chamber 4 against the base wall 7 of the body 3. The resilient material may be a foam or sponge or similar material against which the end of the electronic cigarette 2 will abut when received in the container. The bottom surface of the chamber 4 may be flat and a foam insert may cover the entire bottom surface. The foam insert may be stuck to the bottom surface. A foam insert provides a cushion for the electronic cigarette and also allows for tolerance variations in the plastic parts so that, when the lid is closed, the rib 35 (see FIG. 11*a*) will apply pressure to the end of the electronic cigarette and push it into the foam. Any rattling or movement of the electronic cigarette can thereby be prevented. If the foam insert covers the entire bottom surface, any ancillary article inserted into the chamber may also be cushioned in a similar way.

It will be appreciated that the stopper 33 and wall 34 described with reference to FIG. 9*a* may be provided to a container which does not include an insert 30. That is, for example, if the container described with reference to any of FIGS. 1 to 8*b* had a supporting wall 52 and first opening 10 that did not extend to the base wall 7 then that container may be provided with a stopper 33 and wall 34 to support the end of the electronic cigarette. It will also be appreciated that the container may not comprise a stopper as described above and the electronic cigarette may instead rest on the bottom of the chamber. However, the use of a stopper or a resilient material is advantageous if the bottom of the container is not planar and perpendicular to the direction of the electronic cigarette, as a non-planar base wall may result in the electronic cigarette being twisted within the first opening which may cause the electronic cigarette to become jammed or damaged.

Figure 10:
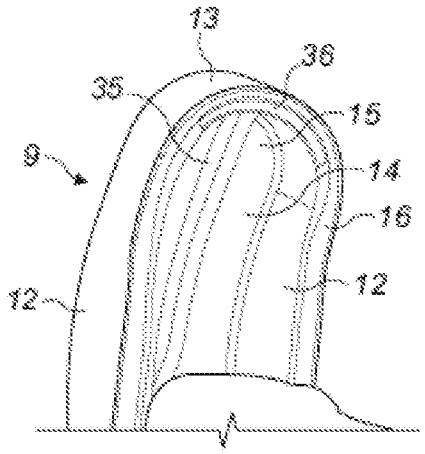
FIG. 10 shows the inside of the lid of the container of FIGS. 9*a* and 9*b*.

As shown in FIG. 10, a rib 35 may extend from the inside face of the top wall 14 of the lid 9, into the second chamber 15 within the lid 9. As shown, the rib 35 extends from the top wall 14 of the lid 9 at least partially across the second chamber 15 so that the rib 35 is disposed above the first opening 10 when the lid 9 is closed. In this way, the rib 35 is disposed adjacent to, or abuts against, the top end of an electronic cigarette 2 which is placed in the container 1 when the lid 9 is closed to prevent movement of the electronic cigarette 2 within the container 1 by restricting the movement of the electronic cigarette 2 in the longitudinal direction within the first opening 10. If the container comprises more than one opening for an electronic cigarette 2 then the rib 35 may extend across the second chamber 15 so that rib 35 is disposed above both the openings to restrict the movement of electronic cigarettes received in both opening.

In an alternative embodiment, the lid 9 does not comprise a rib 35 that extends from the top wall 14 to abut on the end of the electronic cigarette 2 but the lid 9 is configured so that the top wall 14 is disposed adjacent to, or abuts against, the end of the electronic cigarette 2 when the lid 9 is closed. Alternatively, depending on the size of the lid 9 and the distance between the top wall 14 of the lid 9 and the end of the electronic cigarette 2, the lid 9 may comprise any type of protrusion or recess which ensures that, when the lid 9 is closed, a part of the lid 9 is disposed adjacent to, or abuts against, the end of the electronic cigarette 2. As explained, an electronic cigarette placed in the container described with reference to FIGS. 9*a* to 10 will be supported in an upright position by the first opening 10, stopper 33 and, when the lid 9 is closed, the rib 35 in the lid 9. Therefore, the electronic cigarette is prevented from any significant movement within the container which will protect the electronic cigarette whenever it is in the container.

Also shown in FIG. 10, the end wall 13 of the lid 9 on an opposite side to the hinge may be provided with a recess 36 that engages with a similarly shaped protrusion on the body 3 or insert 30 to maintain the position of the lid 9 when it is in a closed position. The engagement between the recess 36 and protrusion will prevent sideways movement and twisting of the lid which may damage the hinge. In another example, the container may comprise the protrusion on the body 3 and not the recess 36 in the lid.

In this example, the protrusion may engage with an internal surface of the lid to maintain the position of the lid when closed.

Figure 11A:
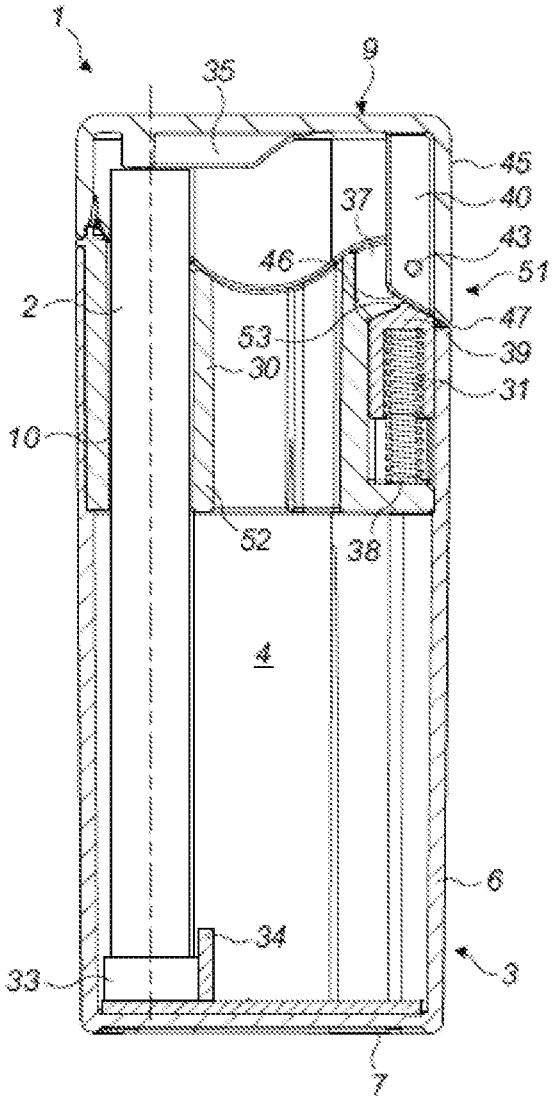
FIG. 11*a* shows a cross-section of the container of FIGS. 9*a* to 10, with the lid in a closed position.
Figure 11C:
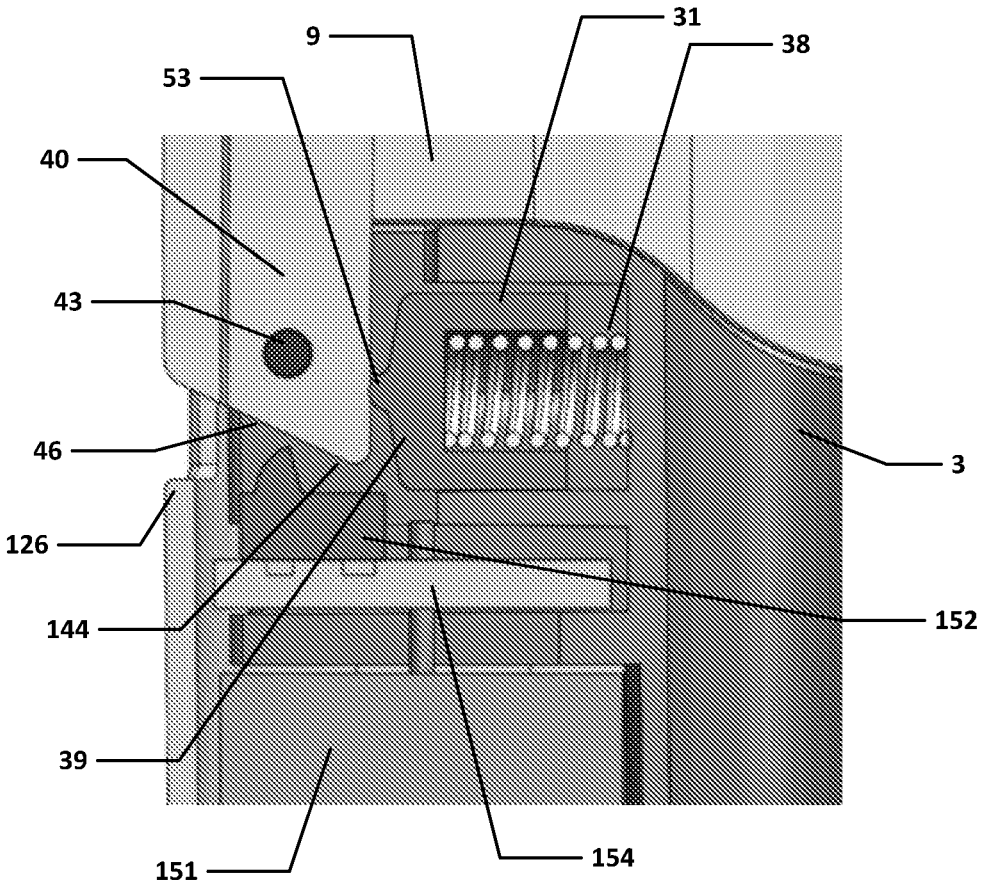
FIG. 11*c* shows a partial cross-section of another example of a container for an electronic cigarette, with the lid in a closed position.
Figure 11B:
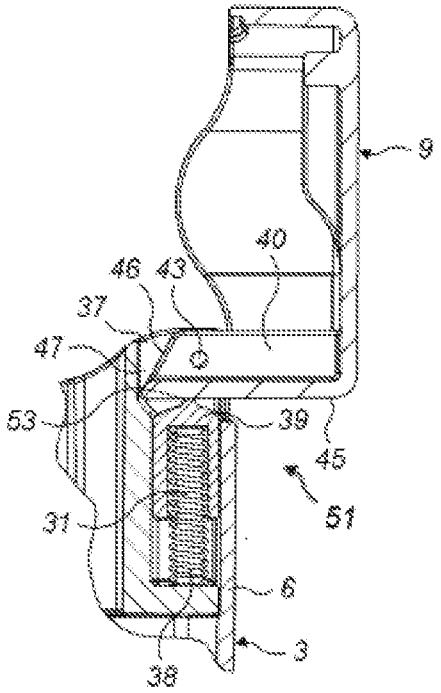
FIG. 11*b* shows a partial cross-section of the container of FIGS. 9*a* to 11*a*, with the lid in an open position.

FIGS. 11*a* and 11*b* show cross-sections of the container 1 described with reference to FIGS. 9*a*, 9*b* and 10. As shown in FIG. 11*a*, which shows the lid 9 in a closed position, the stopper 33 and wall 34 are located on the base wall 7 of the chamber 4, in line with the first opening 10 in the insert 30. Also, the rib 35 in the lid 9 abuts against the top end of the electronic cigarette 2. Therefore, the electronic cigarette 2 positioned in the container 1 is constrained when the lid 9 is closed and significant movement of the electronic cigarette 2 is prevented.

FIGS. 11*a* and 11*b* also show the components of the over-center biased hinge 51.

The hinge 51 of this example is provided with a biased cam member 31 which acts against the lid 9 and provides an over-center biasing action; that is, the biased cam member 31 acts to urge the lid 9 into a closed position during one part of the rotation of the lid 9 and urges the lid 9 into the open position for another part of the rotation of the lid 9.

As shown, the body 3 comprises a hinge recess 37 which receives the biased cam member 31. In this example, the hinge recess 37 is formed in the insert 30, although it will be appreciated that the hinge recess 37 may alternatively be formed in the body 3. The cam member 31 comprises a resilient member, such as a spring 38, and a cam face 39 which pushes against the lid 9, as described below. The cam member 31 may be disposed to exert a force in a direction towards the pin 43, as shown in FIG. 11*a*.

The lid 9 comprises a hinge member 40 which extends from the lid into a cut-out (42, see FIG. 9*b*) in the end wall 6 of the body 3. The cut-out 42 is formed within the end wall 6 and extends to the open end 8 and a matching cut-out (44, see FIG. 9*b*) is formed in the insert 30. The cut-outs 42, 44 allow the hinge member 40 and lid 9 to rotate relative to the body 3. The hinge member 40 comprises a hole which is coaxially aligned with holes (41, see FIG. 9*b*) in the side faces (5, see FIG. 9*b*) of the body 3. A pin 43 extends through the holes in the hinge member 40 and side faces to pivotally mount the lid 9 to the body 3. In this example, the holes in the body and hinge member 40 are located within the chamber 4, that is, between the end walls 6 of the body 3.

As shown in FIGS. 11*a* and 11*b*, the pin 43 is disposed between the end walls 6 of the container. Therefore, the side of the body 3 and the lid 9 are aligned when the lid 9 is closed and there is no protrusion from the side of the container 1. This is advantageous as it makes the container 1 easier to insert into and remove from a pocket and also the hinge 51 is integrated within the container 1 so there is less chance of it becoming damaged.

The cam face 39 of the cam member 31 comprises a curved surface which is pressed against the hinge member 40 of the lid 9 by the spring 38 which acts between the cam face 39 and the hinge recess 37 in the insert 30. Therefore, the cam member 31 applies a force on the lid 9 in a direction away from the body 3 of the container 1.

As shown in FIG. 11*a*, the hinge member 40 comprises a cam element which has an outer face 45 which, when the lid 9 is closed, forms an outer surface of the container within the cut-out (42, see FIG. 9*b*) in the body 3. The cam element of the hinge member 40 also comprises an angled face 46 which is disposed to face towards the cam member 31 when the lid 9 is in a closed position. The angled face 46 of the cam element is disposed such that, when the lid 9 is closed, the cam member 31 pushes against the angled face 46 and the lid 9 is biased to rotate about the pin 43 into the closed position. The cam member 31 pushes against the angled face 46 and creates a moment about the pin 43 which biases the lid 9 to rotate into a closed position. Therefore, to open the lid 9 it must be pivoted against the biasing force provided by the cam member 31.

However, when the lid 9 is rotated into the open position, as shown in FIG. 11*b*, the angled face 46 of the cam element of the hinge member 40 rotates away from the cam member 31 and, at a predetermined intermediate angle of rotation, the edge 47 of the hinge member 40 between the angled face 46 and the outer face 45 moves over the cam face 39 so that the cam member 31 pushes on the outer face 45 to bias the lid 9 to rotate about the pin 43 into an open position. Therefore, after a pre-determined angle of rotation the cam member 31 acts to bias the lid 9 into an open position.

The hinge member 40, in particular the outer face 45 and the angled face 46 of the cam element, may be arranged relative to the cam member 31 such that the biasing action changes direction after a rotation of 45 degrees from the closed position. In this example, for the first 45 degrees of rotation from the closed position the lid 9 will be biased back into the closed position by the cam member 31. However, after more than 45 degrees of rotation the biasing action will change to urge the lid 9 into the open position. It will be appreciated that the hinge member 40 and cam member 31 may be arranged such that the direction of the biasing action changes after a rotation of any pre-determined angle from the closed position, for example 30 degrees, 60 degrees or 90 degrees, or anywhere between these angles. In one embodiment, the lid may be biased open when it has reached somewhere between 35 and 45 degrees.

Also shown in FIGS. 11*a* and 11*b*, the cam face 39 of the cam member 31 may have a protrusion 53 that extends from the cam face 39 to create an audible noise and a small amount of resistance that is felt by the user as the lid 4 is rotated in each direction. As shown in FIGS. 11*a* and 11*b*, the protrusion 53 may be positioned on the cam face 39 so that the edge 47 of the hinge member 40 contacts the protrusion 53 as the direction of the biasing action changes. Therefore, a user is informed, audibly and tactilely, that the hinge has moved over-center and the biasing action will be acting in an opposite direction. Alternatively, the protrusion 53 may be provided on another part of the cam face 39 to inform the user of another lid position. For example, the protrusion 53 may be provided in a position corresponding to a closed position or an open position or any intermediate position.

It will be appreciated that the hinge 51 described with reference to FIGS. 11*a* and 11*b* may be provided to any of the examples of containers described herein. Furthermore, the hinge recess 37 may be formed in the body 3 of the container and not, as described with reference to FIGS. 9*a* to 11*b*, in an insert received in the body 3. Therefore, the sprung over-center biasing hinge is not dependent on the container having an insert.

FIG. 11*c* illustrates a detail of another embodiment of a container to show the operation of the lid 9 as it rotates open and shut about pin 43 (the other portions of this container of FIG. 11*c* may be substantially similar to a container such as already described with respect to the embodiments of FIGS. 1 through 11*b*). In particular, FIG. 11*c* provides a vertical cross-section through the container in the region adjacent to the pin 43 with the lid in the closed position. The body 3 of this container is provided with a cam member 31 including a coil spring 38 which acts as a biasing means, and a cam face 39, the end of which is emphasized by a protrusion 53.

As the lid 9 is rotated open from the closed position shown in FIG. 11*c*, the lid arm (hinge member) 40 pivots in counter-clockwise fashion about pin or axle 43. This rotation causes the lid arm 40 to push against the cam face 39, thereby tending to compress spring 38, which therefore opposes this initial stage of the rotation of the lid. However, once the corner 144 of the lid arm 40 which is furthest from the pin 43 has passed the protrusion 53 on the cam face, further rotation of the lid in an opening direction allows the spring 38 to expand again. In other words, the spring 38 encourages this later stage of rotation, which continues until the arm 40 reaches a mechanical stop as provided by a rim or ledge 126 an outer housing of the body 3 (or any other suitable construct). This two-stage effect of the spring 38 provides an over-center biasing mechanism for the opening of the lid 9, in effect driving the lid to one of two favored positions—either fully open or fully shut (in similar fashion to the embodiment described with respect to FIGS. 11*a* and 11*b*).

Note that in comparison with the embodiments shown in FIGS. 11*a* and 11*b*, the spring 38 is located in a horizontal rather than a vertical direction (in terms of the main axis of compression and expansion). This change in orientation can help to produce a more compact arrangement, thereby leaving greater space in the container, which might be used, for example, to accommodate a (larger) battery 151, such as shown in FIG. 11*c*. This battery may be used to power various electrical and/or electronic functionality within the container, as described in more detail below.

The rotational movement of the lid arm 40 between the open and shut positions also results in a mechanical engagement between the lid arm 40 and a switch 152 attached to a PCB 154. In particular, opening and closing of the lid activate the switch 152 in opposite directions, thereby allowing the state of switch 152 to be used for determining whether the lid 9 of the container is open or shut. The over-center biasing assists in this respect, because it helps to ensure the switch is maintained in one of two definitive positions (on/off), rather than in some more uncertain intermediate position.

In some embodiments, the switch 152 and PCB 154 are used to control certain electronic or electrical functionality of the container. For example, the container may be provided with a light (such as an LED) which is illuminated when the lid is open and extinguished when the lid is closed. As another example, the container may be provided with a facility (such as the battery 151) for re-charging an e-cigarette held within the container, and the re-charging is active when the lid is closed and inactive when the lid is open (and the e-cigarette therefore more likely to be removed). It will be appreciated that electrical and/or electronic functionality of this sort may be integrated into any of the containers described above in relation to FIGS. 1 through 11*b*.

Figure 12:
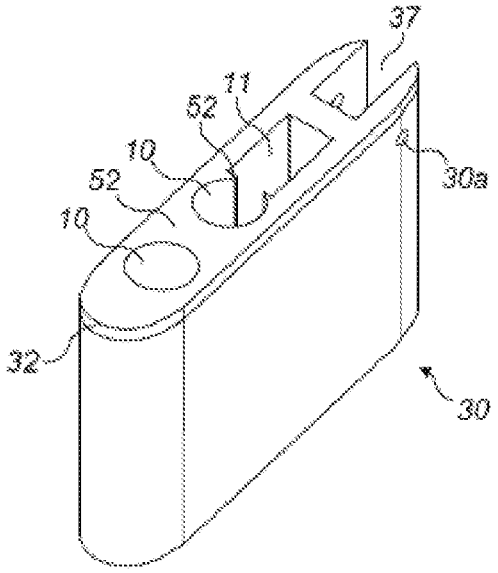
FIG. 12 shows an example of an alternative insert.

FIG. 12 shows an example of an insert 30 which may be received in the body 3 of a container 1. The insert 30 is similar to the insert described with reference to FIGS. 9*a* and 9*b*. The insert shown in FIG. 12 has two supporting walls 52 which provide first and second openings 10, both for receiving and supporting electronic cigarettes, as well as an ancillary opening 11 and the optional hinge recess 37 for the spring mechanism described with reference to FIGS. 11*a* and 11*b*. Also, the insert 30 comprises a lip 32 extending from the top edge so that the insert 30 can be inserted into and supported in the open end of the body 3. In this example, the supporting wall that extends between one of the first and second openings 10 for an electronic cigarette 2 and the ancillary opening 11 is not complete, such that one of the first and second openings 10 for the electronic cigarette and the ancillary opening 11 are joined together. However, it will be appreciated that the supporting wall 52 may extend entirely between those openings 10, 11 to completely separate them. It will also be appreciated that the insert 30 shown in FIG. 12 may be easily adapted for any of the embodiments shown in FIGS. 1 to 11*b*, such that any of the example containers can hold multiple electronic cigarettes.

It will be appreciated that any of the first or second openings or ancillary opening may be formed partially by a portion of the insert and partially by a portion of the body of the container. For example, a semi-cylindrical end wall of the body of the container may combine with a semi-cylindrical end of the insert to create a first opening to receive an electronic cigarette.

It will be appreciated that any of the containers described with reference to FIGS. 1 to 11*b*, may be provided with multiple openings for receiving multiple electronic cigarettes. These multiple openings may be provided in an insert which is received in the chamber of the body or alternatively they may be formed by supporting walls extending from the body itself.

It will also be appreciated that any of the different profiles of the open end 8 of the body 3 and the open face 16 of the lid 9 described with reference to FIGS. 1 to 8*b* may be provided to a container with multiple openings, as shown in the insert of FIG. 12.

In one example, the insert 30 may comprise two openings 10 for electronic cigarettes 2 and a further ancillary opening for an ancillary article arranged such that the ancillary opening is positioned closest to the hinge, with one opening for an electronic cigarette 2 disposed centrally within the chamber. The recessed open end 8 of the body 3 may be as described with reference to FIGS. 8*a* and 8*b*, with a recess 28 disposed centrally and therefore aligned with one of the openings for an electronic cigarette 2.

It will be appreciated that a container may be provided with any of the hinges, body and lid shapes, inserts or any other features and embodiments are not limited to those specific examples described with reference to FIGS. 1 to 12. The examples described with reference to FIGS. 1 to 12 merely provide a range of examples of combinations of different features. Therefore, in a further example, the container described with reference of any of FIGS. 1 to 8*b* may be provided with the over-center biased hinge and/or the insert described with reference to FIGS. 9*a* to 11*b*.

The container 1 may be made from an opaque, translucent or transparent material or a combination thereof. For example, the body 3 may be made of an opaque material and the lid from a transparent material, so that a user is able to see whether an electronic cigarette is within the container. In an alternative example, the body 3 may be made from a transparent material.

Components of the container, such as the body and the lid, may be made from a transparent, translucent or opaque polymer material, such as polycarbonate. Alternatively, the container may be made from a metal, such as tin or aluminum. However, it will be appreciated that the container may be made from any suitable material.

It will be appreciated that the electronic cigarette, for which the containers described are suitable, may have a constant cross-section, for example a constant diameter cylindrical shape. In this case, the first opening and other features that interact with the electronic cigarette will have a size and shape appropriate for the electronic cigarette. However, if the electronic cigarette has a non-constant size, for example if the electronic cigarette changes diameter, the first opening may be formed to match this. This may mean that the electronic cigarette can only be received in the first opening in a specific orientation and this may ensure that an appropriate end of the electronic cigarette is always disposed towards the lid of the container when received within the container.

Any of the example containers described herein may, instead of having a sprung over-center biasing hinge, be provided with a torsion spring (not shown) that biases the lid into a closed position. Alternatively, the hinge of any of the example containers may be free to rotate without any spring action.

Some of the example containers described herein have a curved or shaped appearance and it will be appreciated that the hinge may be provided on any side of the container. For example, the container shown in FIGS. 9*a* and 9*b* has a curved outer shape and, if the container is viewed with the convex side facing towards the viewer, then the hinge is located on the right hand side. However, it will be appreciated that the hinge and any other associated features may alternatively be provided on the opposite side, i.e. the hinge may be provided on the left hand side of the container when viewed with the convex side of the container facing towards the viewer.

All of the example containers described with reference to the Figures are provided for storing and transporting an electronic nicotine delivery system, such as an electronic cigarette, or other flavored vapor delivery system, and optionally also an ancillary article related to that electronic nicotine delivery system or other flavored vapor delivery system. The containers may be used when selling the product, for example as a sales display case or similar, or may be sold separately to the electronic nicotine delivery system. The containers provide protection for the electronic nicotine delivery system during transportation, storage and when being carried by a user. The containers may be pocket-sized to allow a user to easily carry the container, and the electronic nicotine delivery system, on their person. The container is durable and gives protection from impact, crushing and dropping and also protects the contents of the container against dirt and possibly liquids.

In order to address various issues and advance the art, the entirety of this disclosure shows by way of illustration various embodiments in which that which is claimed may be practiced and provide for a superior container for an electronic nicotine delivery system or other flavored vapor delivery system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other embodiments not presently claimed, but which may be claimed in future.

The invention claimed is:

1. A container for an elongate electronic nicotine delivery system or other flavored vapor delivery system, the container comprising:

a rigid elongate body defining a chamber including an end having an opening;

a lid pivotally attached to the body to cover the opening in a closed position, the lid being attached to the body via a hinge comprising a hinge pin, wherein the hinge pin is enclosed within opposing side and end walls of the container such that the hinge pin extends between the opposing side walls and between the opposing end walls, wherein a second chamber is defined within the lid, wherein the chamber and the second chamber are involved in containing an elongate electronic nicotine delivery system or other flavored vapor delivery system in an upright position in the closed position, and wherein the lid comprises a lip having a configuration protruding from a top wall of the lid and within the bounds defined by the lid and proximately located a pivotally attached end of the lid such that a user is able to push on the lip within the bounds defined by the lid to rotate the lid, the lid further including a rib extending from the top wall of the lid and toward the opening;

a switch for detecting whether the lid is in an open position or the closed position;

a facility configured to re-charge the elongate electronic nicotine delivery system or other flavored vapor delivery system held within the chamber when the lid is in the closed position as determined by the switch and the rib abuts the elongate electronic delivery system or other flavored vapor delivery system; and an insert received in the end of the chamber, wherein the hinge pin passes through the insert to retain the insert in the container.

2. The container of claim 1, further comprising an over-center biasing mechanism configured to bias the lid toward the closed position until the lid has been pivoted into an intermediate position, beyond which the lid is biased towards the open position.

3. The container of claim 2, wherein the over-center biasing mechanism comprises a cam member and a cooperating cam element on the lid, the cam member being biased into contact with the cam element by a resilient member so that the lid pivots against a biasing force of the resilient member.

4. The container of claim 3, wherein the cam element of the lid comprises a first surface and a second surface disposed at an angle to each other such that the cam member acts against the first surface to bias the lid towards the closed position and, after the lid is pivoted into the intermediate position, the cam member acts against the second surface to bias the lid towards the open position.

5. The container of claim 4, wherein the cam member comprises a protrusion on a surface of the cam member that contacts the cam element of the lid, the protrusion configured to interact with an edge between the first surface and the second surface of the cam element to generate an audible sound as the edge moves over the protrusion during rotation of the lid.

6. The container of claim 1, wherein the insert further comprises a first opening and an ancillary opening that each lead into the chamber and a dividing wall to separate the first opening and the ancillary opening in the insert so that the elongate electronic nicotine delivery system or other flavored vapor delivery system inserted into the chamber through the first opening protrudes therefrom and is supported in an upright position within the chamber by the insert.

7. The container of claim 1, wherein the lid and the body each have a pair of opposing side walls separated by opposing end walls to define the chamber to receive the electronic nicotine delivery system or other flavored vapor delivery system, wherein the opposing side walls of the body and the lid are arcuate in shape.

8. The container of claim 1, wherein the end of the chamber is shaped so as to define a recess and the opening is formed in the recess in the end of the body.

9. The container of claim 1, wherein the lid has a side wall with an edge that contacts the end of the body when the lid is in the closed position, and wherein the edge has an outwardly protruding region that extends towards the body when the lid is in a closed position.

10. The container of claim 1, wherein the switch is mechanically operated by movement of the lid for detecting whether the lid is in the open position or the closed position.

11. The container of claim 1, wherein the container includes electronic or electrical functionality that is controlled in accordance with the open position or the closed position of the lid as detected by the switch.

12. The container of claim 1, wherein the lid comprises the lip such that a user is able to push on the lip to pivotally rotate the lid from a closed position to an open position.

13. The container of claim 1, wherein the container comprises a polycarbonate material.

14. The container of claim 13, wherein the lid comprises an at least partly transparent polycarbonate material.

15. The container of claim 1, further comprising the electronic nicotine delivery system or other flavored vapor delivery system received in the chamber through the opening.

16. The container of claim 1, wherein the electronic nicotine delivery system or other flavored vapor delivery system is an electronic nicotine delivery system.

17. The container of claim 16, wherein the electronic nicotine delivery system is an electronic cigarette.

18. The container of claim 1, wherein the lid is pivotally attached to the body by at least one pivot hinge, and wherein the lip is proximately located a pivot hinge end of the lid such that a user is able to push on the lip to pivotally rotate the lid about the at least one pivot hinge from the closed position to the open position.

19. The container of claim 1, wherein the lip is formed by a depression defined in the lid.

* * * * *